US012384646B2

(12) United States Patent
Tetsu

(10) Patent No.: US 12,384,646 B2
(45) Date of Patent: Aug. 12, 2025

(54) FOLDING APPARATUS AND IMAGE FORMING APPARATUS

(71) Applicant: FUJIFILM Business Innovation Corp., Tokyo (JP)

(72) Inventor: Yoshiaki Tetsu, Yokohama (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 18/586,785

(22) Filed: Feb. 26, 2024

(65) Prior Publication Data

US 2024/0199367 A1 Jun. 20, 2024

Related U.S. Application Data

(62) Division of application No. 17/446,076, filed on Aug. 26, 2021, now Pat. No. 11,945,676.

(30) Foreign Application Priority Data

May 21, 2021 (JP) ..... 2021-086402
May 21, 2021 (JP) ..... 2021-086403
(Continued)

(51) Int. Cl.
*B65H 45/20* (2006.01)
*B65H 37/06* (2006.01)

(52) U.S. Cl.
CPC ..... *B65H 37/06* (2013.01)

(58) Field of Classification Search
CPC ..... B41L 43/06; B65H 45/04; B65H 45/18; B65H 45/20; G03G 2215/00877
(Continued)

(56) References Cited

U.S. PATENT DOCUMENTS 6,895,212 B2 5/2005 Yamakawa et al.
7,052,005 B2 5/2006 Yamakawa et al.
(Continued)

FOREIGN PATENT DOCUMENTS

JP 2005-306585 A 11/2005
JP 5471211 B2 4/2014
(Continued)

OTHER PUBLICATIONS

Nov. 19, 2024 Office Action issued in Japanese Patent Application No. 2021-086402.
(Continued)

*Primary Examiner* — Leslie A Nicholson, III
(74) *Attorney, Agent, or Firm* — Oliff PLC

(57) ABSTRACT

A folding apparatus includes: a folding unit configured to fold a recording medium at an intermediate portion in a transport direction of the recording medium; an upstream roller pair disposed on an upstream side in the transport direction of the recording medium with respect to the folding unit, and configured to transport the folded recording medium toward the folding unit with a fold as a leading end; and a downstream roller pair disposed on a downstream side in the transport direction of the recording medium with respect to the folding unit, and configured to sandwich and transport the recording medium sandwiched between the upstream roller pair, the downstream roller pair being configured to apply a transport force to a portion of the recording medium that is connected to a portion of the recording medium that is sandwiched between the upstream roller pair.

5 Claims, 34 Drawing Sheets

(30) Foreign Application Priority Data

May 21, 2021 (JP) ..... 2021-086404
May 21, 2021 (JP) ..... 2021-086405

(58) Field of Classification Search
USPC ..... 270/32, 39.01
See application file for complete search history.

(56) References Cited

U.S. PATENT DOCUMENTS

| | | | | |
|---|---|---|---|---|
| 7,207,557 | B2 | 4/2007 | Kaneko et al. | |
| 7,850,160 | B2 | 12/2010 | Kato et al. | |
| 8,276,899 | B2 | 10/2012 | Kimata et al. | |
| 8,366,596 | B2 | 2/2013 | Hayashi | |
| 8,534,660 | B2 | 9/2013 | Honda | |
| 8,851,464 | B2 | 10/2014 | Shimizu | |
| 9,212,020 | B2 * | 12/2015 | Nakada | B65H 45/20 |
| 9,302,880 | B2 | 4/2016 | Awano | |
| 2003/0062666 | A1 * | 4/2003 | Hosoya | B65H 45/14 270/58.07 |

FOREIGN PATENT DOCUMENTS

| | | | |
|---|---|---|---|
| JP | 2015-48210 | A | 3/2015 |
| JP | 2015-151247 | A | 8/2015 |
| JP | 2016-216185 | A | 12/2016 |
| JP | 2017-88357 | A | 5/2017 |

OTHER PUBLICATIONS

Nov. 19, 2024 Office Action issued in Japanese Patent Application No. 2021-086404.
Nov. 19, 2024 Office Action issued in Japanese Patent Application No. 2021-086403.
Nov. 19, 2024 Office Action issued in Japanese Patent Application No. 2021-086405.
Apr. 15, 2025 Office Action issued in Japanese Patent Application No. 2021-086403.
Apr. 22, 2025 Office Action issued in Japanese Patent Application No. 2021-086404.
Apr. 22, 2025 Office Action issued in Japanese Patent Application No. 2021-086405.

* cited by examiner

FOLDING APPARATUS AND IMAGE FORMING APPARATUS

CROSS-REFERENCE TO RELATED APPLICATIONS

This is a Divisional Application of U.S. patent application Ser. No. 17/446,076, filed Aug. 26, 2021, which is based on and claims priority under 35 USC 119 from Japanese Patent Application No. 2021-086402 filed on May 21, 2021, Japanese Patent Application No. 2021-086403 filed on May 21, 2021, Japanese Patent Application No. 2021-086404 filed on May 21, 2021 and Japanese Patent Application No. 2021-086405 filed on May 21, 2021, the entire disclosures of each of which are incorporated by reference herein.

BACKGROUND

Technical Field

The present disclosure relates to a folding apparatus and an image forming apparatus.

Related Art

Japanese Patent No. 5471211 describes a fold creating apparatus that creates a fold on each sheet by a fold creating unit provided in a front section of a folding mechanism that performs folding process. The fold creating apparatus includes: a detector configured to detect a position of a sheet; grippers arranged on an upstream side and a downstream side in a sheet transport direction with respect to the fold creating unit and configured to grasp the sheet; and a bending corrector configured to apply a tension to the sheet between the two holding units to correct bending. The fold creating apparatus corrects bending by the bending correcting unit before creating the fold by the fold creating unit.

SUMMARY

Incidentally, with respect to a recording medium to be folded plural times, the folded recording medium may be wrinkled.

Aspects of non-limiting embodiments of the present disclosure relate to providing a folding apparatus and an image forming apparatus capable of preventing wrinkles of a recording medium even when the recording medium is to be folded plural times, as compared to a configuration in which a downstream roller pair applies a transport force to a portion of the recording medium on a side that is not sandwiched by an upstream roller pair with respect to a fold of the recording medium.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a folding apparatus including: a folding unit configured to fold a recording medium at an intermediate portion in a transport direction of the recording medium; an upstream roller pair disposed on an upstream side in the transport direction of the recording medium with respect to the folding unit, and configured to transport the folded recording medium toward the folding unit with a fold as a leading end; and at least one downstream roller pair disposed on a downstream side in the transport direction of the recording medium with respect to the folding unit, and configured to sandwich and transport the recording medium sandwiched between the upstream roller pair, the downstream roller pair being configured to apply a transport force to a portion of the recording medium that is connected to a portion of the recording medium that is sandwiched between the upstream roller pair.

Aspects of non-limiting embodiments of the present disclosure relate to providing a folding apparatus and an image forming apparatus capable of improving accuracy with respect to a folding position of a recording medium, as compared to a configuration in which a transport roller pair arranged on a downstream side in a transport direction with respect to a folding unit is always in a nip state.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a folding apparatus including: at least one folding unit configured to fold a recording medium at an intermediate portion in a transport direction of the recording medium; an upstream roller pair disposed on an upstream side in the transport direction of the recording medium with respect to the folding unit, and configured to transport the folded recording medium toward the folding unit; a downstream roller pair disposed on a downstream side in the transport direction of the recording medium with respect to the folding unit, and configured to transport the folded recording medium along the transport direction; and at least one transport roller pair disposed on a side opposite to a side of the folding unit with respect to the downstream roller pair, and configured to switch between a nip state and a nip release state, in which the folding apparatus is configured to bring the transport roller pair into the nip release state when the recording medium is to be folded by the folding unit.

Aspects of non-limiting embodiments of the present disclosure relate to providing a folding apparatus and an image forming apparatus capable of preventing occurrence of wrinkles in a recording medium, as compared to a case where, when the recording medium is to be folded, the recording medium is pressed into between a folding roller pair constituting a folding unit while rotating the folding roller pair.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a folding apparatus including: a folding unit including a folding roller pair and a pressing member configured to press a folding target portion of a recording medium into between the folding roller pair, the folding roller pair being configured to rotate so as to fold the recording medium while transporting the recording medium, in which the folding apparatus has a control mode in which rotation of the folding roller pair is started after the recording medium pressed by the pressing member comes into contact with the folding roller pair.

Aspects of non-limiting embodiments of the present disclosure relate to providing a folding apparatus and an image forming apparatus that increase the number of types of folding forms of a recording medium, as compared to a configuration in which the number of folding units is two or less.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a folding apparatus including: a first folding unit configured to fold and transport a recording medium; a second folding unit provided on a downstream side in a transport direction of the recording medium with respect to the first folding unit, and configured to fold and transport the recording medium; and a third folding unit provided on the downstream side in the transport direction of the recording medium with respect to the second folding unit, and configured to fold and transport the recording medium.

BRIEF DESCRIPTION OF THE DRAWINGS

Exemplary embodiments of the present invention will be described in detail based on the following figures, wherein.

DETAILED DESCRIPTION

Hereinafter, an example of embodiments of the present disclosure will be described in detail with reference to the drawings.

First Exemplary Embodiment

Figure 1:
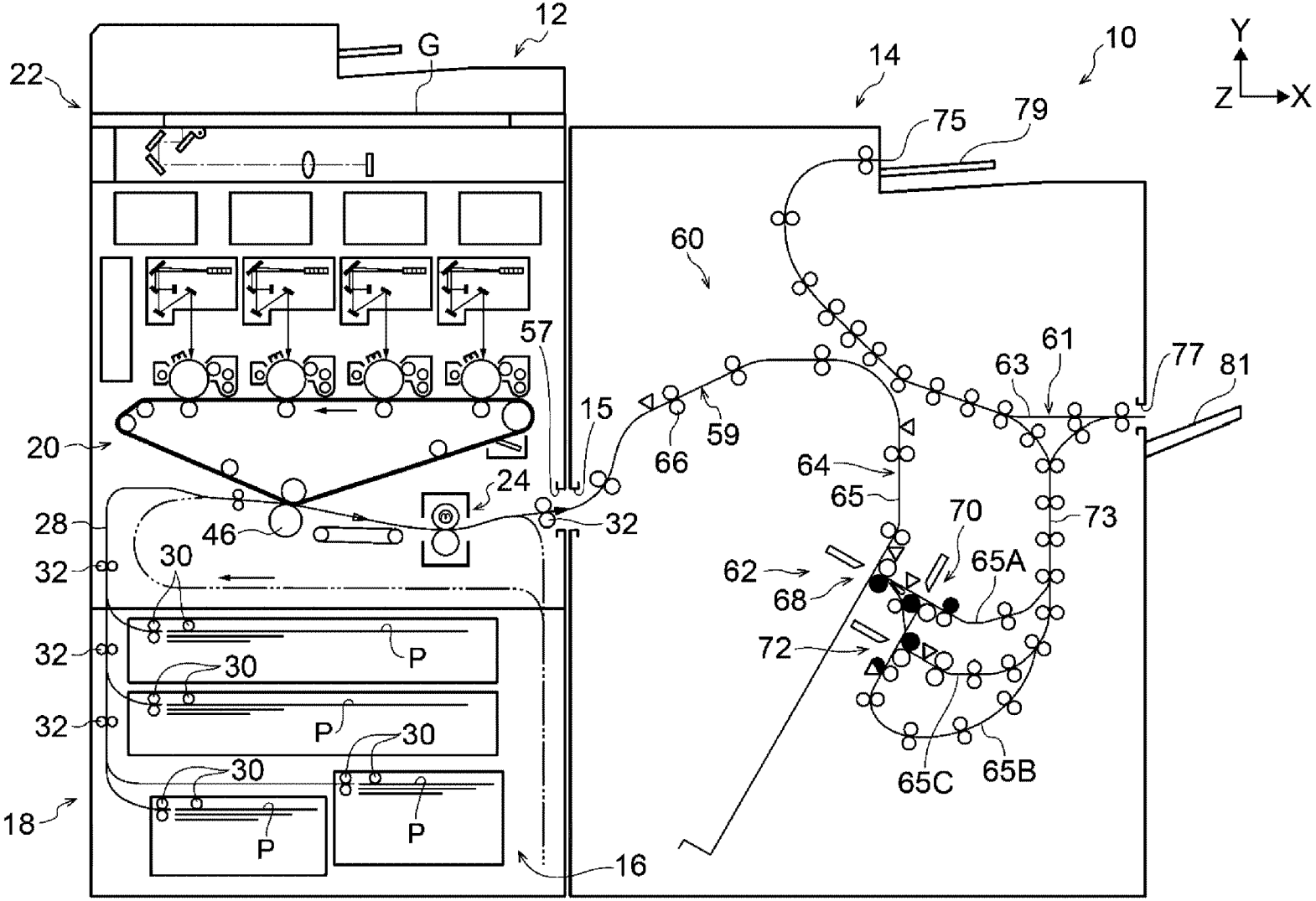
FIG. 1 is a front cross-sectional view illustrating an example of an image forming apparatus including a folding apparatus according to a first exemplary embodiment.

FIG. 1 illustrates an example of an image forming apparatus 10 including a folding apparatus 14 according to a first exemplary embodiment, and is a front cross-sectional view of the image forming apparatus 10 as viewed from a front side.

As illustrated in FIG. 1, the image forming apparatus 10 according to the present exemplary embodiment includes an image forming apparatus main body (forming unit) 12 that forms an image on a sheet member P as a recording medium, and a folding apparatus 14 that creates a fold on the sheet member P (folds the sheet member P).

In the present exemplary embodiment, an apparatus width direction (horizontal direction) is defined as an X direction, an apparatus upper-lower direction (vertical direction) is defined as a Y direction, and an apparatus depth direction (horizontal direction) is defined as a Z direction. In the present exemplary embodiment, it is assumed that the X direction, the Y direction, and the Z direction are orthogonal to each other.

Figure 2:
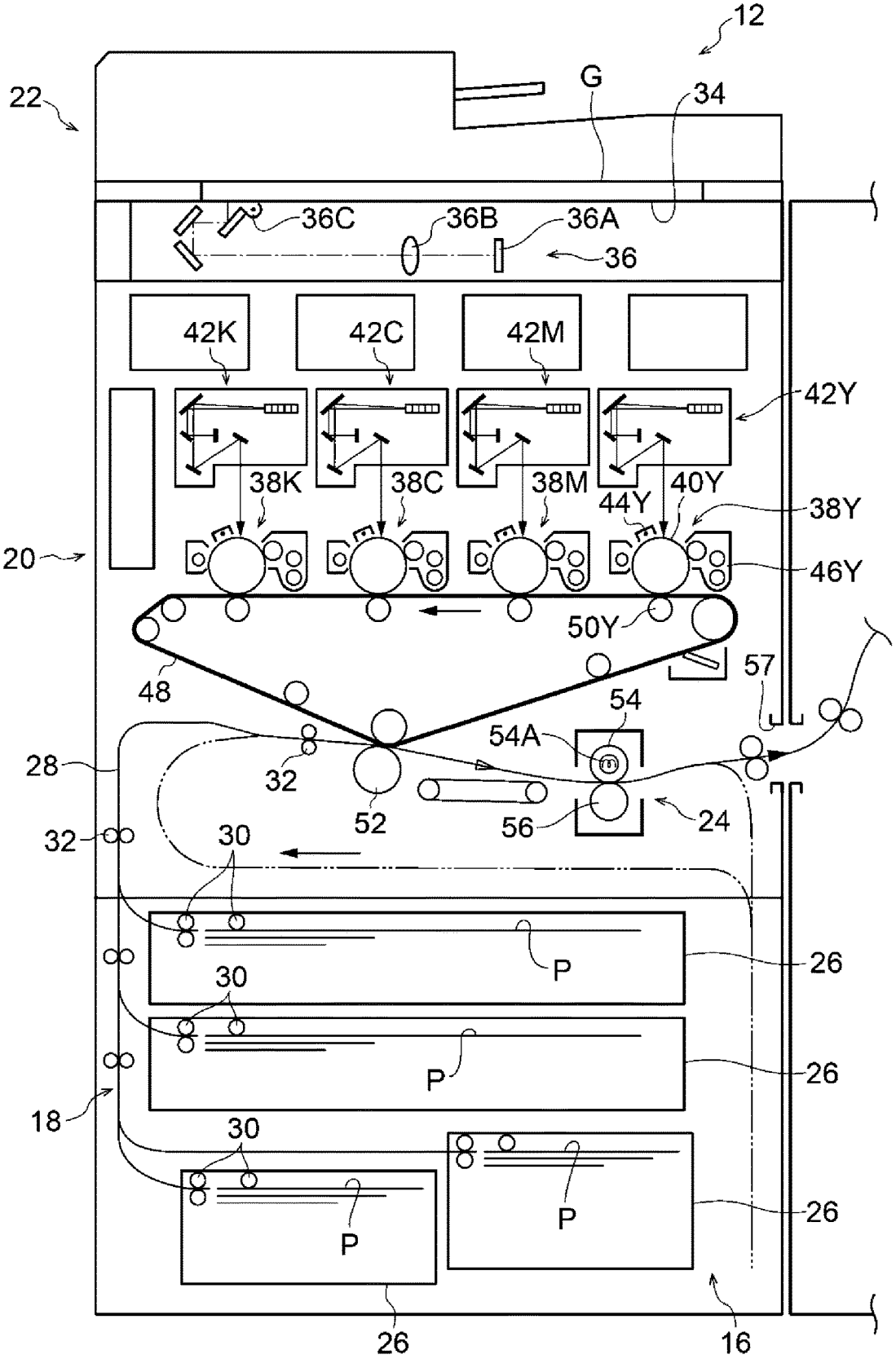
FIG. 2 is a front cross-sectional view illustrating a main body side of the image forming apparatus of FIG. 1.

FIG. 2 illustrates an example of an image forming apparatus main body 12, and is a front cross-sectional view of the apparatus main body 12 as viewed from the front side.

As illustrated in FIG. 2, the image forming apparatus main body 12 according to the present exemplary embodiment includes a supply unit 16, a transport unit 18, an image forming unit 20, and an image reading unit 22 in this order. The supply unit 16 supplies the sheet member P from a lower side to an upper side in the Y direction. The transport unit 18 transports the sheet member P supplied by the supply unit 16. The image forming unit 20 forms a toner image on the sheet member P transported by the transport unit 18. The image reading unit 22 reads an image of a document G. The image reading unit 22 is an example of a reader. The image forming apparatus 10 further includes a fixing unit 24 that heats and pressurizes the sheet member P formed with the toner image so as to fix the toner image on the recording medium.

The supply unit 16 is provided with plural accommodation members 26 that can be pulled out forward from the image forming apparatus main body 12 in the Z direction, and sheet members P are stacked in each of the accommodation members 26. The accommodation member 26 is provided with delivery rollers 30 that deliver the sheet members P stacked in the accommodation member 26 to a transport route 28 constituting the transport unit 18. The transport unit 18 is provided with plural transport roller pairs 32 that transport the sheet members P along the transport route 28.

The image reader 22 includes a platen glass 34 on which the document G is placed, and a reading unit 36 that reads an image of the document G placed on the platen glass 34. The reading unit 36 includes a CCD (Charge Coupled Device) 36A, a lens 36B, and a lamp 36C. Reflected light of light emitted from the lamp 36C to the document G is received by the CCD 36A via the lens 36B. As a result, the image of the document G is read, and image data is obtained.

The image forming unit 20 includes four image forming units 38Y, 38M, 38C, and 38K for yellow (Y), magenta (M), cyan (C), and black (K). In the following description, Y, M, C, K may be omitted when Y, M, C, K need not be distinguished from each other. Further, the image forming section 20 is provided with an exposure device 42 of each color that irradiates an image carrier 40 (only an image carrier 40Y is shown) provided in the image forming unit 38 with exposure light based on the image data read by the reading unit 36.

The image forming unit 38 of each color is attachable to and detachable from the image forming apparatus main body 12. The image forming unit 38 of each color includes an image carrier 40 and a charging member 44 (only a charging member 44Y is illustrated) that charges a surface of the image carrier 40. Further, the image forming unit 38 of each color is provided with a developing device 46 (only a developing device 46Y is illustrated) that develops an electrostatic latent image formed by the exposure device 42 irradiating the charged image carrier 40 with exposure light to visualize the electrostatic latent image as a toner image.

The image forming unit 20 includes an endless transfer belt 48 that circulates in a direction of an arrow A in the drawing, and a primary transfer roller 50 (only a primary transfer roller 50Y is illustrated) that transfers the toner image formed by the image forming unit 38 of each color to the transfer belt 48. The image forming unit 20 further includes a secondary transfer roller 52 that transfers the toner image transferred to the transfer belt 48 to the sheet member P.

In the image forming apparatus 10 according to the present exemplary embodiment, an image is formed as follows.

First, the charging member 44 (only the charging member 44Y is illustrated) of each color applied with a voltage charges the surface of the image carrier 40 of each color uniformly and negatively at a predetermined potential. Subsequently, based on the image data read by the reading unit 36, the exposure device 42 irradiates the charged surface of the image carrier 40 of each color with the exposure light to form the electrostatic latent image.

Thereby, the electrostatic latent image corresponding to the image data is formed on the surface of the image carrier 40 of each color. Further, the developing device 46 of each color develops the electrostatic latent image and visualizes the electrostatic latent image as a toner image. The toner image formed on the surface of the image carrier 40 of each color is transferred to the transfer belt 48 by the primary transfer roller 50.

Then, the sheet member P delivered from the accommodation member 26 to the transport route 28 by the delivery roller 30 is delivered to a transfer position T where the transfer belt 48 and the secondary transfer roller 52 are in contact with each other. At the transfer position T, the sheet member P is transported between the transfer belt 48 and the secondary transfer roller 52, whereby the toner image on the surface of the transfer belt 48 is transferred to the sheet member P.

The toner image transferred onto the sheet member P is fixed to the sheet member P by the fixing unit 24. The fixing unit 24 is disposed on the downstream side in the transport direction of the sheet member P with respect to the secondary transfer roller 52, and includes a heating roller 54 that is rotationally driven by a rotational force transmitted from a stepping motor (not illustrated). A halogen heater 54A is disposed inside the heating roller 54.

The fixing unit 24 includes a pressurizing roller 56 that is supported in a manner capable of rotating while pressurizing the transported sheet member P toward the heating roller 54. The sheet member P to which the toner image is transferred is sandwiched and transported by the heating roller 54 and the pressurizing roller 56, so that the sheet member P is heated and pressurized and the toner image is fixed to the sheet member P. Then, the sheet member P to which the toner image is fixed is discharged to the outside of the image forming apparatus main body 12 through a discharge port 57.

Folding Apparatus

Next, the folding apparatus 14 according to the present exemplary embodiment will be described.

Figure 3:
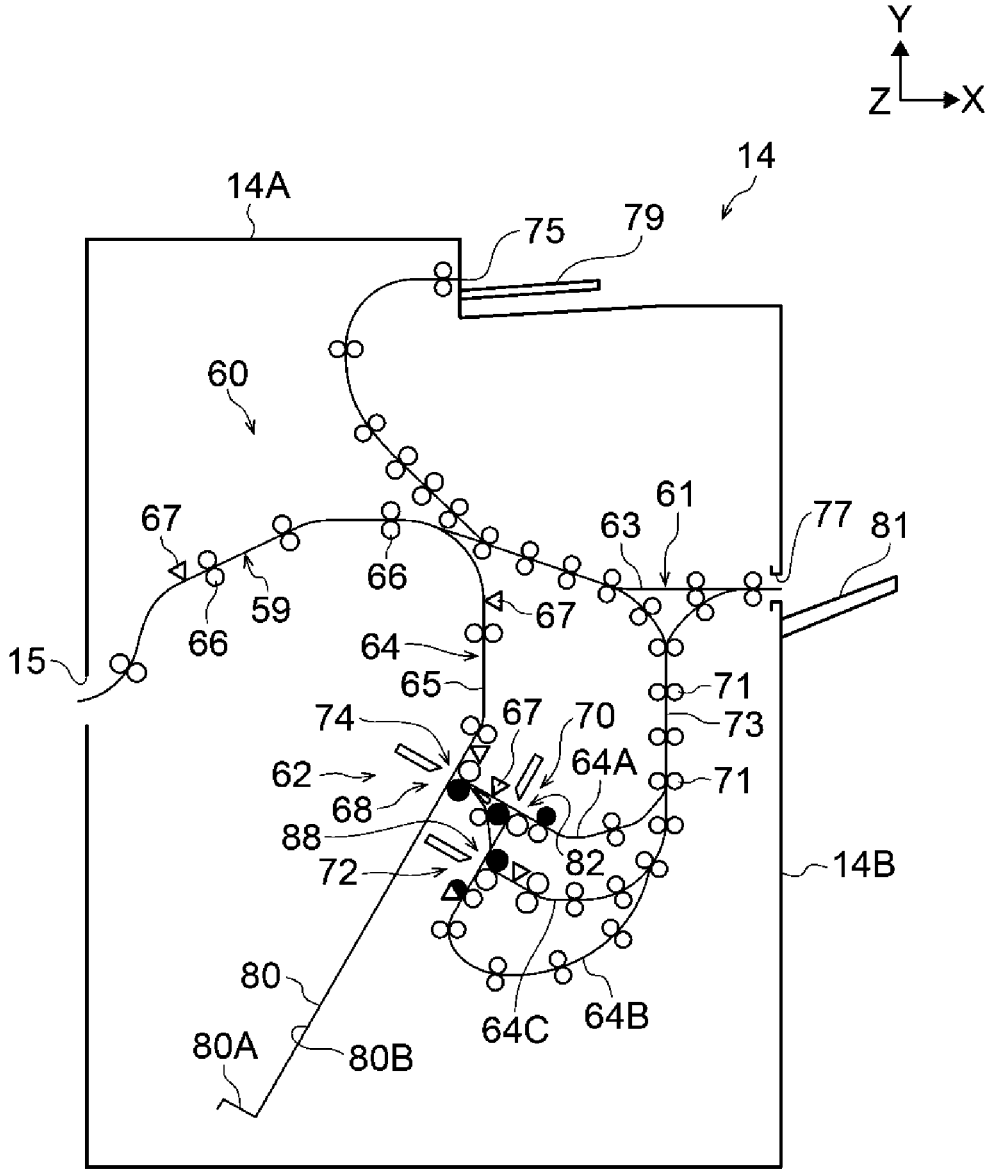
FIG. 3 is a front cross-sectional view illustrating a folding apparatus side of FIG. 1.

FIG. 3 is a front cross-sectional view of the folding apparatus 14 as viewed from the front side. As shown in FIGS. 1 and 3, the folding apparatus 14 is provided with an inlet 15 connected to the discharge port 57 provided in the image forming apparatus main body 12. The folding apparatus 14 includes a transport unit 60 that transports the sheet member P discharged from the image forming apparatus main body 12 through the inlet 15, and a folding unit 62 that performs folding process on the sheet member P transported by the transport unit 60 (folds the sheet member P).

The transport unit 60 includes plural transport roller pairs 66 that transport the sheet member P along a transport path 59 in which the sheet member P is transported. The transport path 59 is provided with plural sensors 67, and detects a leading end and a trailing end of the transported sheet member P. When the sheet member P is detected by the sensors 67, a driving timing is adjusted in roller pairs including a folding roller pair 74 and the like, which will be described later.

The transport path 59 includes a transport path 61 (transport route 63) for discharging the sheet member P to the outside of the folding apparatus 14 without performing folding process on the sheet member P, and a transport path 64 (transport route 65) for performing folding process on the sheet member P.

The transport route 63 is a path for transporting the sheet member P discharged from the image forming apparatus main body 12 in the X direction (horizontal direction). The transport route 65 is a path for folding the sheet member P discharged from the image forming apparatus main body 12 and transporting the sheet member P. The transport route 65 includes plural transport routes 65A, 65B, 65C and the like corresponding to folding specifications of the sheet member P (described later).

On the other hand, the transport path 64 is provided with the folding unit 62. The folding unit 62 includes a first folding unit 68, a second folding unit 70, and a third folding unit 72.

Figure 4:
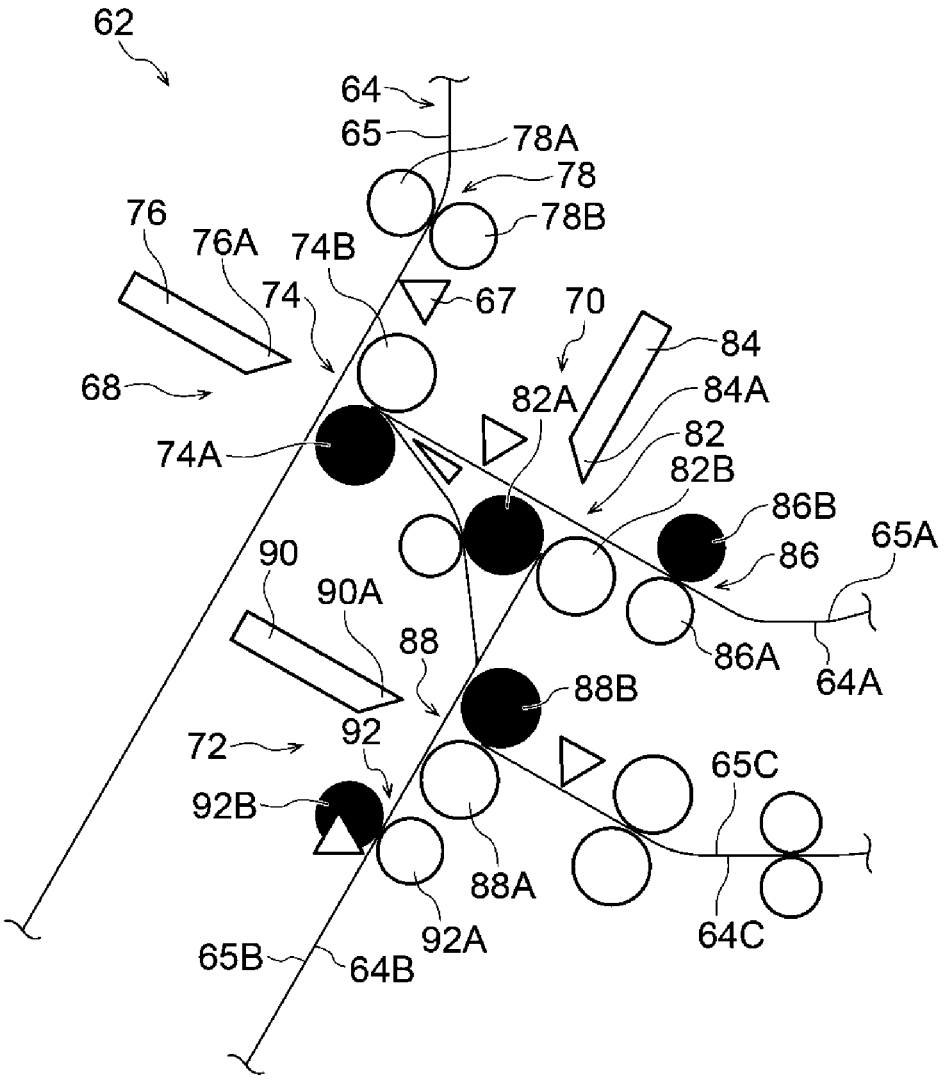
FIG. 4 is an enlarged view illustrating a folding unit of the folding apparatus according to the first exemplary embodiment in an enlarged manner.

FIG. 4 is an enlarged view illustrating the folding unit 62 in an enlarged manner. As illustrated in FIG. 4, the first folding unit 68 includes a folding roller pair 74 that has roller shapes in pair, and a pressing member 76.

The folding roller pair 74 includes folding rollers 74A, 74B. The folding rollers 74A, 74B are disposed along the transport direction of the sheet member P with a direction intersecting (orthogonal to; the same hereinafter) the transport direction of the sheet member P as a longitudinal direction, and apply a transport force to the sheet member P.

On the other hand, the pressing member 76 is disposed on an opposite side of the folding roller pair 74 with respect to the transport path 64, and is provided with a direction intersecting with the transport direction of the sheet member P as a longitudinal direction. Further, a leading end portion 76A of the pressing member 76 is formed in an acute shape, and can press a part of the transported sheet member P (folding target position) between the folding roller 74A and the folding roller 74B.

When the part of the sheet member P is pressed into between the folding roller 74A and the folding roller 74B via the pressing member 76, the sheet member P is folded with the part of the sheet member P as a starting point, and when the sheet member P passes between the folding roller 74A and the folding roller 74B, a fold Q1 (see FIG. 8B) is created on the sheet member P.

A transport path 64A is provided between the folding roller 74A and the folding roller 74B along a direction intersecting the transport path 64. A route along which the sheet member P is transported by the transport path 64A branched from the transport path 64 is a transport route 65A, and the sheet member P folded once by the folding roller pair 74 of the first folding unit 68 is transported.

The transport path 64A is connected, on the downstream side of the sheet member P in the transport direction, to a transport path 73 that includes plural roller pairs 71 illustrated in FIG. 3 and transports the sheet member P to discharge ports 75, 77 described later. Therefore, for example, when the sheet member P is folded only once, such as two-folding, the sheet member P is transported to the outside of the folding apparatus 14 by the transport path 64A and the transport path 73.

In the present exemplary embodiment, the folding apparatus 14 is provided with the two discharge ports 75, 77. The discharge port 75 is provided in the transport route 65, and is formed on a side of an upper surface 14A of the folding apparatus 14. On the other hand, the discharge port 77 is provided in the transport routes 63, 65, and is formed in a right side surface 14B of the folding apparatus 14 in the drawings. The discharge ports 75, 77 are provided with discharge trays 79, 81, respectively, and the folded sheet members P are discharged onto the respective discharge trays 79, 81.

In the present exemplary embodiment, as illustrated in FIG. 1, the image forming apparatus 10 includes the image forming apparatus main body 12 that forms an image on the sheet member P, and the folding apparatus 14, but may also be provided with a post-processing device that performs bookbinding such as a binding process. In this case, the discharge port 77 discharges the sheet member P toward the post-processing device.

As illustrated in FIG. 4, an upstream roller pair 78 is provided on the upstream side in the transport direction of the sheet member P with respect to the first folding unit 68. The upstream roller pair 78 includes an upstream roller 78A and an upstream roller 78B. The upstream rollers 78A, 78B are provided with a direction intersecting the transport direction of the sheet member P as a longitudinal direction. The upstream roller 78A and the upstream roller 78B are arranged with the transport path 64 interposed therebetween. The upstream roller 78A and the upstream roller 78B sandwich the sheet member P to apply a transport force to the sheet member P.

As shown in FIG. 3, a guide 80 is provided on the downstream side in the transport direction of the sheet member P with respect to the first folding unit 68. The guide 80 is provided substantially along the upper-lower direction of the folding apparatus 14. Strictly speaking, the guide 80 is inclined toward the lower side of the folding apparatus 14 as closer to the image forming apparatus main body 12 side.

Further, an abutment portion 80A is provided at a leading end of the guide 80. The abutment portion 80A is formed along a direction intersecting the transport direction of the sheet member P, and is erected with respect to a transport surface 80B of the guide 80. Therefore, when the sheet member P is transported to the guide 80, the sheet member P abuts against the abutment portion 80A of the guide 80, and movement of the sheet member P is restricted.

Here, the guide 80 is capable of extending and contracting along the transport direction of the sheet member P. For example, the guide 80 includes a slide member that slides with respect to a main body portion along the transport direction of the sheet member P. The abutment portion 80A is formed at the leading end of the slide member, and a position of the abutment portion 80A is adjusted according to the folding position and the size of the sheet member P.

As illustrated in FIG. 4, similar to the first folding unit 68, the second folding unit 70 includes a folding roller pair 82 that has roller shapes in pair, and a pressing member 84.

The folding roller pair 82 includes folding rollers 82A, 82B. The folding rollers 82A, 82B are disposed along the transport direction of the sheet member P with a direction intersecting the transport direction of the sheet member P as a longitudinal direction, and apply a transport force to the sheet member P.

On the other hand, the pressing member 84 is disposed on an opposite side of the folding roller pair 82 with respect to the transport path 64A, and is provided with a direction intersecting with the transport direction of the sheet member P as a longitudinal direction. Further, a leading end portion 84A of the pressing member 84 is formed in an acute shape. The pressing member 84 can come into contact with and separate from the transport path 64A, and can press another part of the transported sheet member P (folding target position) between the folding roller 82A and the folding roller 82B.

When said another part of the sheet member P is pressed into between the folding roller 82A and the folding roller 82B via the pressing member 84, the sheet member P folded once is folded with said another part of the sheet member P as a starting point, and when the sheet member P passes between the folding roller 82A and the folding roller 82B, a fold Q2 (see FIG. 9) is created on the sheet member P.

A transport path 64B is provided between the folding roller 82A and the folding roller 82B along a direction intersecting the transport path 64A. A route along which the sheet member P is transported by the transport path 64B branched from the transport path 64A is the transport route 65B, and the sheet member P folded twice by the folding roller pair 74 of the first folding unit 68 and the folding roller pair 82 of the second folding unit 70 is transported.

The transport path 64B is connected, on the downstream side in the transport direction of the sheet member P, to the transport path 73 connected to the transport path 64A. Therefore, for example, when the sheet member P is folded only twice, such as Z-folding and three-folding, the sheet member P is transported to the outside of the folding apparatus 14 by the transport path 64B and the transport path 73.

On the other hand, the folding roller pair 74 of the first folding unit 68 is provided on the upstream side in the transport direction of the sheet member P with respect to the second folding unit 70. In the second folding unit 70, the folding roller pair 74 of the first folding unit 68 also serves as an upstream roller pair, the folding roller 74A and the folding roller 74B are arranged with the transport path 64A interposed therebetween, and the folding roller 74A and the folding roller 74B sandwich the sheet member P and apply a transport force to the sheet member P.

A downstream roller pair 86 is provided on the downstream side in the transport direction of the sheet member P with respect to the second folding unit 70. The downstream roller pair 86 includes a downstream roller 86A and a downstream roller 86B. The downstream rollers 86A, 86B are provided with a direction intersecting the transport direction of the sheet member P as a longitudinal direction. The downstream roller 86A and the downstream roller 86B are arranged with the transport path 64A interposed therebetween. The downstream roller 86A and the downstream roller 86B sandwich the sheet member P to apply a transport force to the sheet member P.

Each of the downstream rollers 86A and 86B can be connected to a motor via a clutch (not shown), and is switched between connected to or disconnected from the motor. Therefore, when one downstream roller side is connected to the motor via the clutch, a driving force is transmitted to the one downstream roller side. At this time, the other downstream roller side is in a state where the connection with the motor is released via the clutch.

In the present exemplary embodiment, the downstream roller 86B side is a so-called driving roller, and the transport force is applied to the sheet member P by driving the downstream roller 86B. A downstream roller pair 92 described below is also substantially the same as the downstream roller pair 86. In addition, in the description, when necessary for a roller pair, a driving roller is indicated by a black circle.

Incidentally, according to a folding form of the sheet member P, a folded side P2 of the sheet member P may be folded toward one surface side or toward the other surface side of the sheet member P. On the other hand, in the present exemplary embodiment, similar as the downstream roller pair 86, one roller and the other roller constituting the roller pair can be each connected to the motor via the clutch, and either the one roller or the other roller can be a driving roller. Therefore, in the present exemplary embodiment, it is possible to appropriately decide which one of the pair of rollers constituting the roller pair is to be the driving side in accordance with the folding form of the sheet member P.

Similar to the first folding unit 68 and the second folding unit 70, the third folding unit 72 includes a folding roller pair 88 that has roller shapes in pair, and a pressing member 90.

The folding roller pair 88 includes folding rollers 88A, 88B. The folding rollers 88A, 88B are disposed along the transport direction of the sheet member P with a direction intersecting the transport direction of the sheet member P as a longitudinal direction, and apply a transport force to the sheet member P.

On the other hand, the pressing member 90 is disposed on an opposite side of the folding roller pair 88 with respect to the transport path 64B, and is provided with a direction intersecting with the transport direction of the sheet member P as a longitudinal direction. Further, a leading end portion 90A of the pressing member 90 is formed in an acute shape. The pressing member 90 can come into contact with and separate from the transport path 64B, and can press still another part of the transported sheet member P (folding target position) between the folding roller 88A and the folding roller 88B.

When the still another part of the sheet member P is pressed into between the folding roller 88A and the folding roller 88B via the pressing member 90, the sheet member P folded twice is folded with the still another part of the sheet member P as a starting point, and when the sheet member P passes between the folding roller 88A and the folding roller 88B, a fold Q3 (see FIG. 10A) is created on the sheet member P.

A transport path 64C is provided between the folding roller 88A and the folding roller 88B along a direction intersecting the transport path 64B. A route along which the sheet member P is transported by the transport path 64C branched from the transport path 64B is the transport route 65C, and the sheet member P folded three times by the folding roller pair 74 of the folding unit 68, the folding roller pair 82 of the second folding unit 70, and the folding roller pair 88 of the third folding unit 72 is transported.

The transport path 64C is connected, on the downstream side in the transport direction of the sheet member P, to the transport path 73 connected to the transport path 64A and the transport direction 64B. That is, the transport path 73 is a transport path in which the transport path 64A, the transport path 64B, and the transport path 64C are joined to each other. When the sheet member P is folded three times, such as bellows folding and gates folding, the sheet member P is transported to the outside of the folding apparatus 14 by the transport path 64C and the transport path 73.

On the other hand, the folding roller pair 82 of the second folding unit 70 is provided on the upstream side in the transport direction of the sheet member P with respect to the third folding unit 72. In the third folding unit 72, the folding roller pair 82 of the second folding unit 70 also serves as an upstream roller pair, the folding roller 82A and the folding roller 82B are arranged with the transport path 64B interposed therebetween, and the folding roller 82A and the folding roller 82B sandwich the sheet member P and apply a transport force to the sheet member P.

A downstream roller pair 92 is provided on the downstream side in the transport direction of the sheet member P with respect to the third folding unit 72 The downstream roller pair 92 includes a downstream roller 92A and a downstream roller 92B. The downstream rollers 92A and 92B are provided with a direction intersecting the transport direction of the sheet member P as a longitudinal direction. The downstream roller 92A and the downstream roller 92B are arranged with the transport path 64B interposed therebetween. The downstream roller 92A and the downstream roller 92B sandwich the sheet member P to apply a transport force to the sheet member P. In the downstream roller pair 92, the downstream roller 92B side is a driving roller, and the transport force is applied to the sheet member P by driving the downstream roller 92B.

Operation of Folding Apparatus

An operation of the folding apparatus 14 according to the first exemplary embodiment will be described.

As illustrated in FIG. 3, in the image forming apparatus 10 including the folding apparatus 14 according to the present exemplary embodiment, when a user selects not to perform folding process, the transport route 63 is selected in the folding apparatus 14, and the sheet member P formed with the image and discharged from the image forming apparatus main body 12 is discharged to the outside of the folding apparatus 14.

On the other hand, when the user selects to perform the folding process, the transport route 65 is selected in the folding apparatus 14, and the sheet member P discharged from the image forming apparatus main body 12 is subjected to the folding process.

Figure 8A:
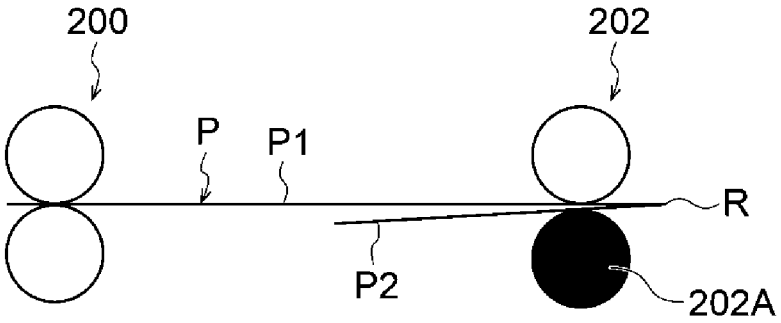
FIG. 8A is a comparative example illustrating a relationship between a folded recording medium and a driving roller.
Figure 8B:
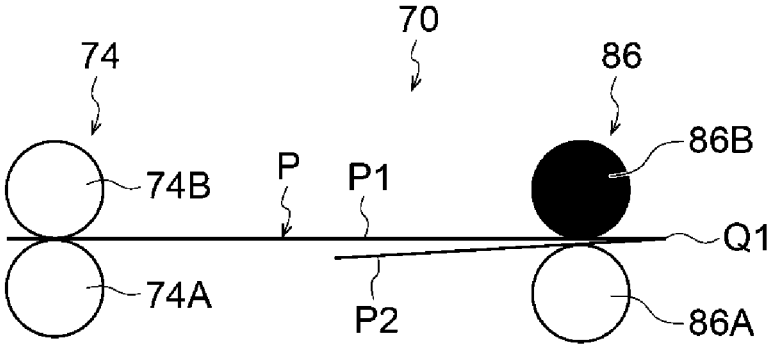
FIG. 8B is an enlarged view illustrating a relationship between a folded recording medium and a driving roller in the first folding unit of the folding apparatus according to the first exemplary embodiment in an enlarged manner.
Figure 9:
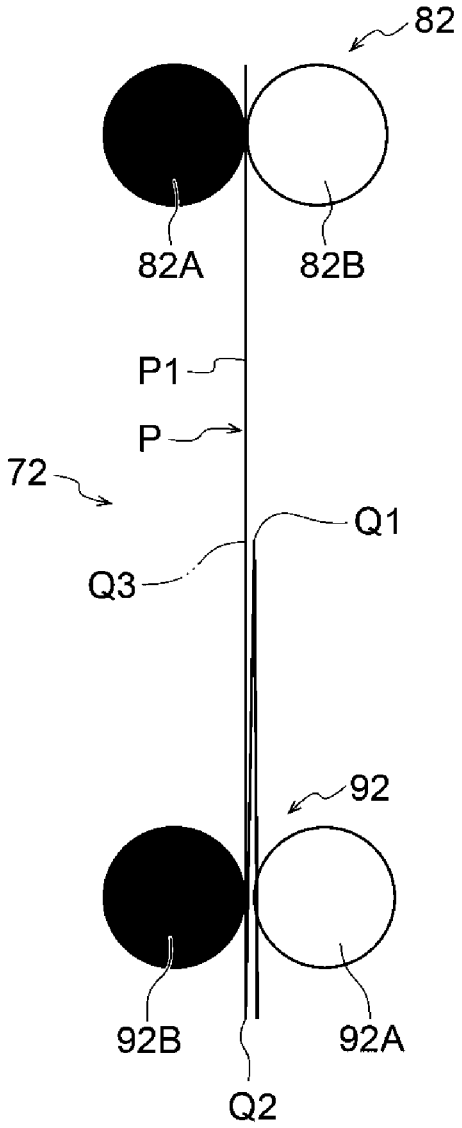
FIG. 9 is an enlarged view illustrating a relationship between the folded recording medium and a driving roller in the second folding unit of the folding apparatus according to the first exemplary embodiment in an enlarged manner.
Figure 10A:
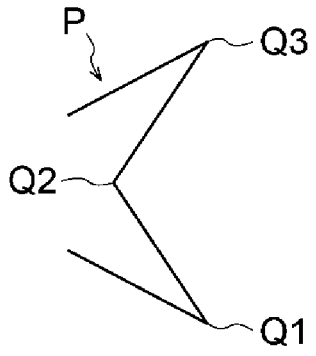
FIG. 10A is a view illustrating bellows folding of the recording medium.

For example, as illustrated in FIG. 10A, a case in which the sheet member P is subjected to bellows folding (folded three times) will be described with reference to FIGS. 3 and 5 to 9. The sheet member P shown in FIGS. 8A, 8B and 9 is shown in an exaggerated manner, such as that a gap is provided between folded portions, so that a folded state of the sheet member P can be understood.

As shown in FIG. 3, the sheet member P transported by the transport path 64 constituting the transport route 65 is guided toward the guide 80 provided on the downstream side in the transport direction of the sheet member P with respect to the first folding unit 68, and the leading end of the sheet member P abuts against the abutment portion 80A of the guide 80. As a result, the leading ends of the sheet members P are aligned.

Figure 5:
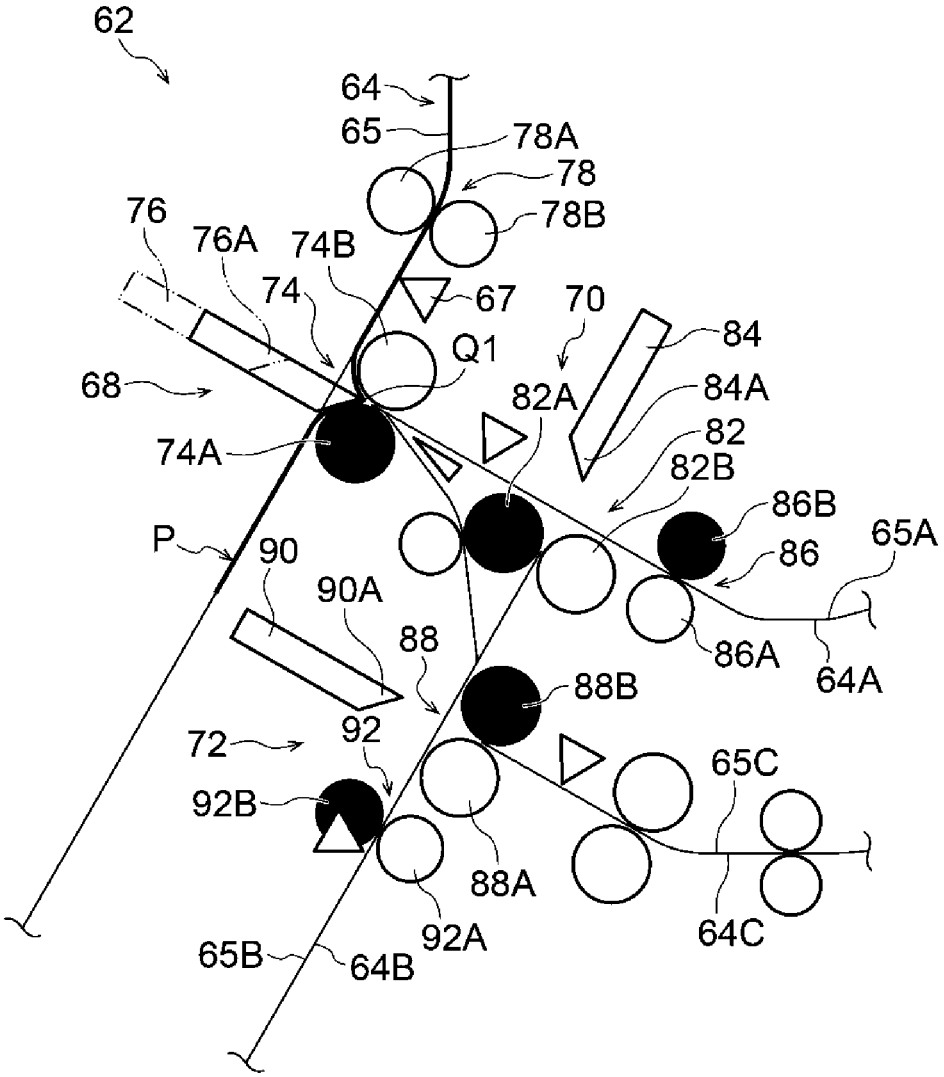
FIG. 5 is an enlarged view illustrating an operation of a first folding unit of the folding apparatus according to the first exemplary embodiment.

In this state, as illustrated in FIG. 5, the sheet member P is subjected to a first folding process in the first folding unit 68 (the sheet member P is folded). In the first folding unit 68, the pressing member 76 approaches the transport path 64, and the sheet member P is pressed into between the folding roller 74A and the folding roller 74B by the leading end portion 76A of the pressing member 76.

At this time, in the folding roller pair 74, the folding roller 74A is driven, and the transport force is applied to the sheet member P by driving the folding roller 74A. The sheet member P passes between the folding roller 74A and the folding roller 74B in a state of being folded from the part (folding target position) of the sheet member P. As a result, the fold Q1 (see FIG. 8B) is created on the sheet member P, and the sheet member P is transported to the transport path 64A with the fold Q1 at the leading end.

Figure 6:
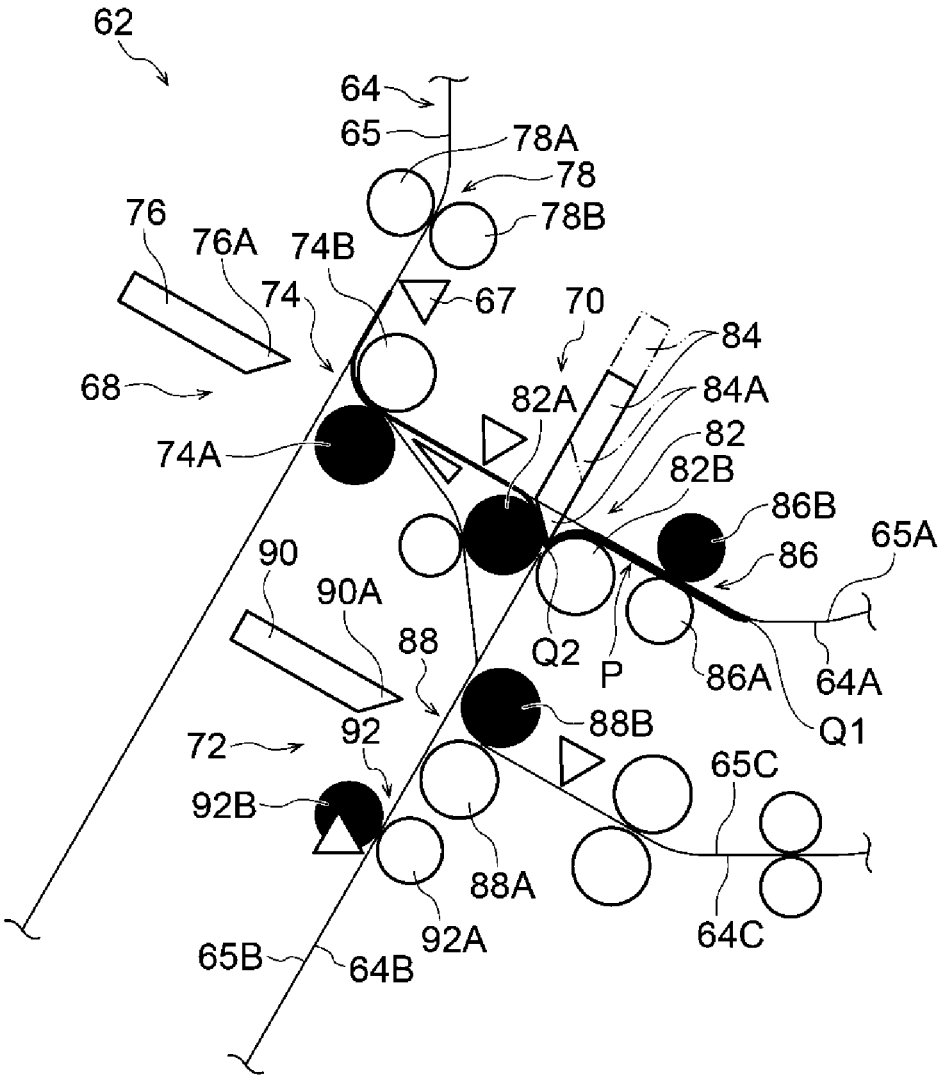
FIG. 6 is an enlarged view illustrating an operation of a second folding unit serving as the folding unit of the folding apparatus according to the first exemplary embodiment with a main part thereof enlarged.

Next, as illustrated in FIG. 6, the sheet member P on which the fold Q1 is created is subjected to a second folding process in the second folding unit 70. The second folding unit 70 is provided with the folding roller pair 74 as an upstream roller pair at the upstream side in the transport direction by the second folding unit 70, and is provided with the downstream roller pair 86 at the downstream side in the transport direction by the second folding unit 70.

The sheet member P is sandwiched by the folding roller pair 74 and the downstream roller pair 86, and in this state, the pressing member 84 approaches the transport path 64A, and the leading end portion 84A of the pressing member 84 is pressed into between the folding roller 82A and the folding roller 82B via the sheet member P.

Here, a comparative example will be described. As illustrated in FIG. 8A, a sheet member Pb is sandwiched between an upstream roller pair 200 and between a downstream roller pair 202 on a side P1 continuous to the sheet member P sandwiched by the upstream roller pair 200. On the other hand, the folded side P2 of the sheet member P is not sandwiched by the upstream roller pair 200, and thus is only sandwiched by the downstream roller pair 202.

In this state, a roller 202A on the side in contact with the folded side P2 of the sheet member P is driven, and a transport force is applied to the sheet member P. That is, when the downstream roller pair 202 applies the transport force to the portion of the sheet member P on the side without being sandwiched by the upstream roller pair 200 with respect to a fold R of the sheet member P, since a trailing end portion of the folded side P2 of the sheet member P is in a free state, the folded side P2 of the sheet member P is transported, the fold R of the sheet member P is displaced, and the folded sheet member P is wrinkled.

In contrast, in the present exemplary embodiment, as illustrated in FIG. 8B, in the downstream roller pair 86, the downstream roller 86B is the driving side, and the transport force is applied to the sheet member P by the downstream roller 86B. In the present exemplary embodiment, the downstream roller 86B is in contact with the side P1 that is continuous with the sheet member P sandwiched by the folding roller pair 74 as the upstream roller pair. That is, in the present exemplary embodiment, the downstream roller pair 86 applies the transport force to the portion of the sheet member P that is connected to the portion of the sheet member P that is sandwiched between the folding roller pair 74 as the upstream roller pair.

Therefore, even when the downstream roller 86B is driven and the transport force is applied to the sheet member P, the sheet member P is sandwiched by the folding roller pair 74 as the upstream roller pair, so that the fold Q1 of the sheet member P may be prevented from displacing, and the folded sheet member P may be be prevented from wrinkling. In FIG. 8B, illustration of the folding roller pair 82 is omitted.

On the other hand, as illustrated in FIG. 6, in a state in which the sheet member P on which the fold Q1 is created is pressed into between the folding roller 82A and the folding roller 82B by the leading end portion 84A of the pressing member 84, the transport force is applied to the sheet member P by driving the folding roller 82A.

The sheet member P passes between the folding roller 82A and the folding roller 82B in a state of being folded from said another part (folding target position) of the sheet member P. As a result, in addition to the fold Q1, the fold Q2 (see FIG. 9) is created on the sheet member P, and the sheet member P is transported to the transport path 64B with the fold Q2 at the leading end. In FIG. 9, illustration of the folding roller pair 88 is omitted.

Figure 7:
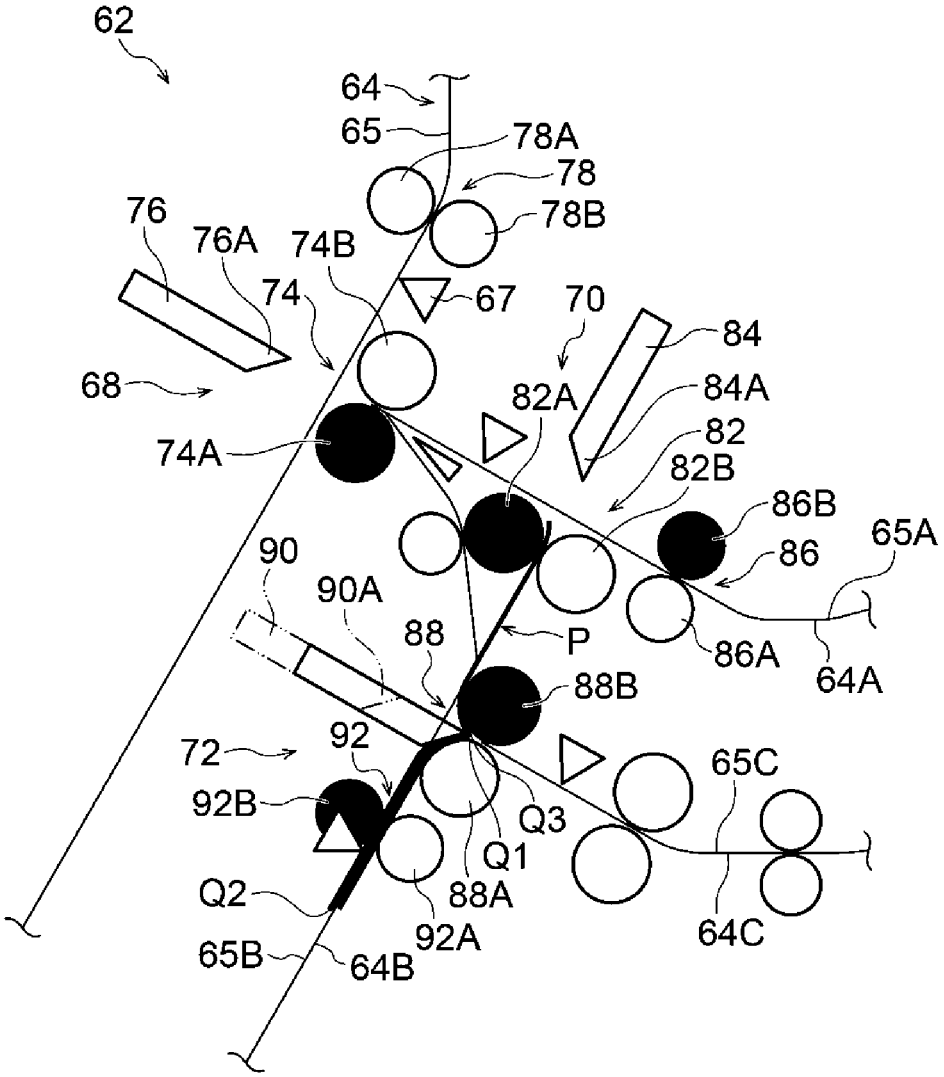
FIG. 7 is an enlarged view illustrating an operation of a third folding unit serving as the folding unit of the folding apparatus according to the first exemplary embodiment with a main part thereof enlarged.

Further, as illustrated in FIG. 7, the sheet member P on which the folds Q1, Q2 are created is subjected to a third folding process in the third folding unit 72. The third folding unit 72 is provided with the folding roller pair 82 as an upstream roller pair at the upstream side in the transport direction by the third folding unit 72, and is provided with the downstream roller pair 92 at the downstream side in the transport direction by the third folding unit 72.

The sheet member P is sandwiched by the folding roller pair 82 and the downstream roller pair 92, and in this state, the pressing member 90 approaches the transport path 64B, and the leading end portion 90A of the pressing member 90 is pressed into between the folding roller 88A and the folding roller 88B via the sheet member P.

Here, in the present exemplary embodiment, as illustrated in FIG. 9, in the downstream roller pair 92, the downstream roller 92B is the driving side, and the transport force is applied to the sheet member P by the downstream roller 92B. In the present exemplary embodiment, the downstream roller 92B is in contact with the side P1 that is continuous with the sheet member P sandwiched by the folding roller pair 82 as the upstream roller pair. That is, in the present exemplary embodiment, the downstream roller pair 92 applies the transport force to the portion of the sheet member P that is connected to the portion of the sheet member P that is sandwiched between the folding roller pair 82 as the upstream roller pair.

Therefore, even when the downstream roller 92B is driven and the transport force is applied to the sheet member P, the sheet member P is sandwiched by the folding roller pair 82 as the upstream roller pair, so that the folds Q1, Q2 of the sheet member P are prevented from displacing, and the folded sheet member P may be prevented from wrinkling.

On the other hand, as illustrated in FIG. 7, in a state in which the sheet member P on which the folds Q1, Q2 are created is pressed into between the folding roller 88A and the folding roller 88B by the leading end portion 90A of the pressing member 90, the transport force is applied by driving the folding roller 88B.

The sheet member P passes between the folding roller 88A and the folding roller 88B in a state of being folded from the still another part (folding target position) of the sheet member P. As a result, in addition to the folds Q1, Q2, the fold Q3 (see FIG. 9) is created on the sheet member P, and the sheet member P is transported to the transport path 64C with the fold Q3 at the leading end. In this way, the sheet member P is subjected to bellows folding (see FIG. 10A).

As described above, in the present exemplary embodiment, for example, as illustrated in FIG. 8B, in the downstream roller pair 86, the downstream roller 86B that is the driving side is in contact with the side P1 connected to the sheet member P sandwiched by the folding roller pair 74 as the upstream roller pair, and applies the transport force.

Therefore, wrinkles of the sheet member P are prevented even when the sheet members P is folded plural times, as compared to a configuration in which the roller 202A on the driving side is in contact with the folded side P2 and applies the transport force as illustrated in FIG. 8A described as a comparative example.

In the present exemplary embodiment, similar as the downstream roller pairs 86, 92, the one roller and the other roller constituting the roller pair can be each connected to the motor via the clutch, and either the one roller or the other roller is the driving roller. Thereby, it is possible to appropriately decide which one of the pair of rollers constituting the roller pair is to be the driving side in accordance with the folding form of the sheet member P.

Therefore, in the present exemplary embodiment, the downstream roller pairs 86, 92 apply the transport force to the portions of the sheet member P that are connected to the portions of the sheet member P that are respectively sandwiched between the folding roller pairs 74, 82 as the upstream roller pairs, regardless of the folding form.

As described above, in the present exemplary embodiment, it is possible to appropriately decide which one of the pair of rollers constituting the roller pair is to be the driving side in accordance with the folding form of the sheet member P. Thereby, it is possible to use the same transport path even for sheet members P having different folding forms. Accordingly, a size of the folding apparatus 14 may be reduced as compared to a configuration in which the transport path is provided according to the folding form of the sheet member P.

In the present exemplary embodiment, as illustrated in FIG. 3, the guide 80 is provided on the downstream side in the transport direction of the sheet member P with respect to the first folding unit 68, and the abutment portion 80A is provided at the leading end of the guide 80. The sheet member P abuts against the abutment portion 80A of the guide 80 before the folding process by the first folding unit 68 is performed on the sheet member P.

In this way, by the sheet member P abutting against the abutment portion 80A of the guide 80 before the folding process by the first folding unit 68 is performed on the sheet member P, the leading end of the sheet member P is positioned. Therefore, even when the sheet member P is obliquely transported, the leading end of the sheet member P abuts against the abutment portion 80A so as to be positioned, so that variation in the folding position of the sheet member P by the first folding unit 68 is prevented as compared to a configuration in which a roller pair is on the downstream side in the transport direction of the sheet member P with respect to the first folding unit 68.

Here, the guide 80 is provided substantially along the upper-lower direction of the folding apparatus 14, and is capable of extending and contracting along the transport direction of the sheet member P, so that the position of the abutment portion 80A can be moved. That is, in the present exemplary embodiment, the position of the abutment portion 80A can be changed according to the size of the sheet member P and the folding position of the sheet member P by the first folding unit 68.

Further, by providing the guide 80 along the substantially upper-lower direction of the folding apparatus 14, for example, it is possible to reduce an installation area of the folding apparatus 14 and to reduce the size of the folding apparatus 14, as compared to a configuration in which the guide 80 is provided along the horizontal direction.

In the present exemplary embodiment, the folding unit 62 for folding the sheet member P is provided at three positions (the first folding unit 68, the second folding unit 70, and the third folding unit 72). As a result, in the present exemplary embodiment, the sheet member P can be folded three times, and the folding forms are increased as compared to the case where the number of folding units is two or less.

Figure 10B:
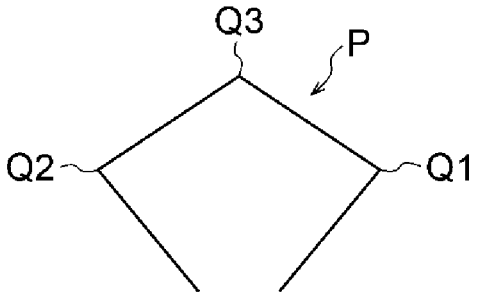
FIG. 10B is a view illustrating gates folding of the recording medium.
Figure 11A:
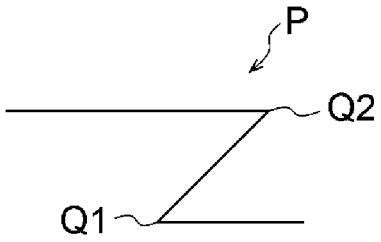
FIG. 11A is a view illustrating Z-folding of the recording medium.
Figure 11B:
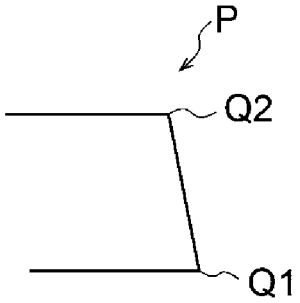
FIG. 11B is a line view illustrating inward three-folding of the recording medium.
Figure 11C:
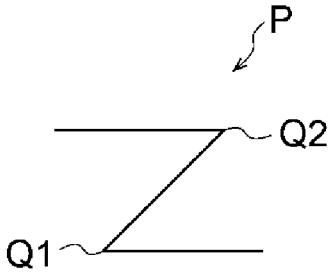
FIG. 11C is a view illustrating outward three-folding of the recording medium.
Figure 11D:
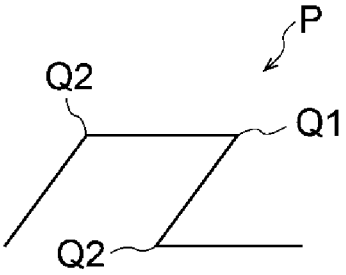
FIG. 11D is a view illustrating four-folding of the recording medium.

Here, as the folding forms, for example, the case where the sheet member P is folded twice is exemplified by a Z-folding shown in FIG. 11A, an inner three-folding shown in FIG. 11B, an outer three-folding shown in FIG. 11C, and a four-folding shown in FIG. 11D. On the other hand, the case where the sheet member P is folded three times is exemplified by the gates folding illustrated in FIG. 10B, in addition to the bellows folding illustrated in FIG. 10A. In other words, in the present exemplary embodiment, it is possible to perform the gates folding, the bellows folding, and the like of the sheet member P, which cannot be performed in the case where the number of folding units is two or less.

In the present exemplary embodiment, the folding roller pair 74 of the first folding unit 68 illustrated in FIG. 4 also serves as an upstream roller pair of the second folding unit 70. The folding roller pair 82 of the second folding unit 70 also serves as an upstream roller pair of the third folding unit 72. Therefore, for example, the number of components is reduced in the present exemplary embodiment, as compared to a configuration in which dedicated upstream roller pairs are provided for the second folding unit 70 and the third folding unit 72. Of course, dedicated upstream roller pairs may be provided for the second folding unit 70 and the third folding unit 72.

Modification of First Exemplary Embodiment

Figure 12:
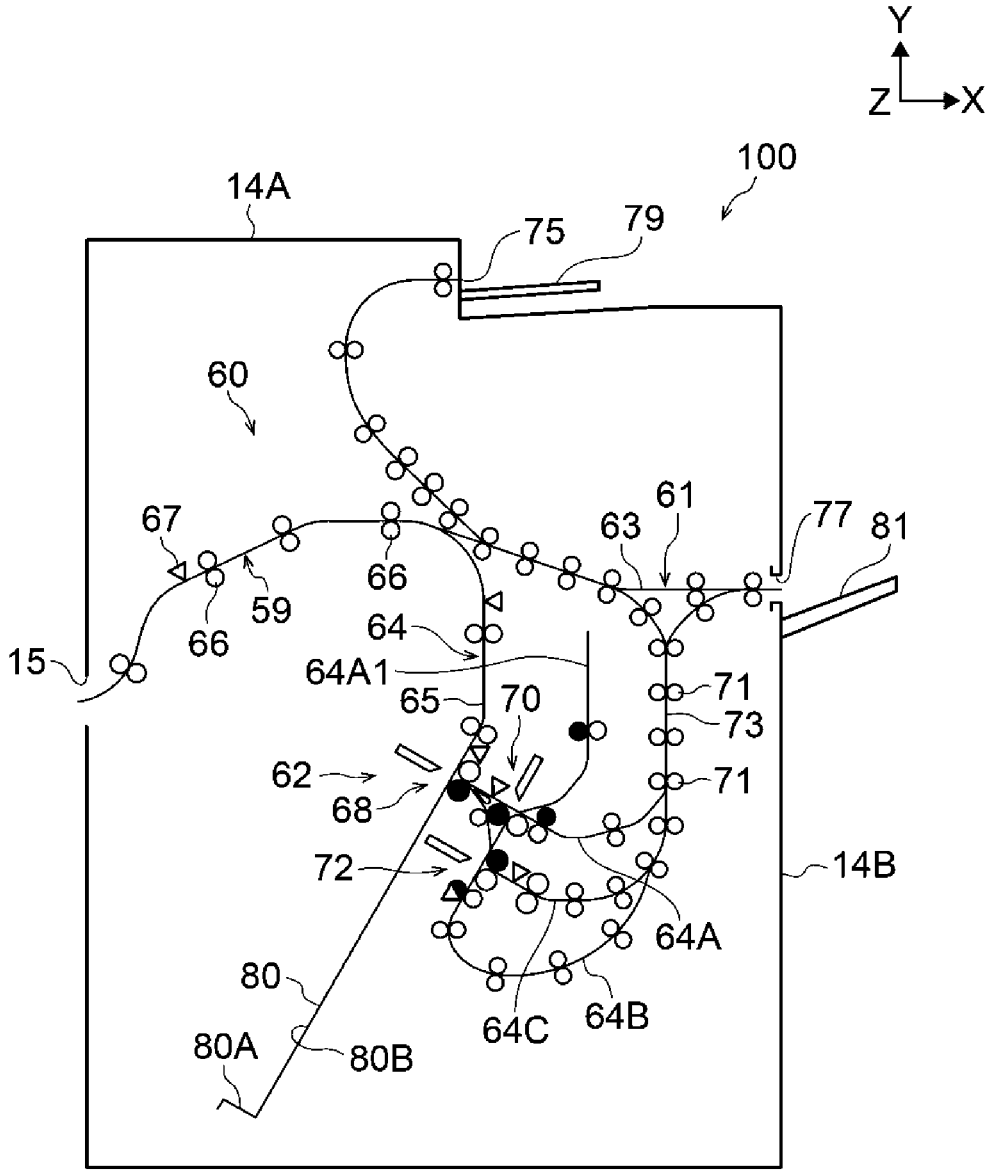
FIG. 12 is a front cross-sectional view illustrating a folding apparatus according to a modification of the first exemplary embodiment.

FIG. 12 is a front cross-sectional view of the folding apparatus 100 according to a second exemplary embodiment as viewed from a front side. Description of substantially the same contents as those of the folding apparatus 14 according to the first exemplary embodiment will be omitted.

In the folding apparatus 14 according to the first exemplary embodiment illustrated in FIG. 3 and FIG. 4, for example, in the downstream roller pair 86 of the second folding unit 70, the driving roller is switched between the downstream roller 86A side and the downstream roller 86B side depending on whether or not connected to the motor. As shown in FIG. 8B, in accordance with the folding form of the sheet member P, the transport force is applied to the sheet member P by using, as the driving side, the downstream roller 86B on the side in contact with the side P1 connected to the sheet member P sandwiched by the folding roller pair 74 as the upstream roller pair.

However, the downstream roller pair of the folding unit may have any configuration as long as the downstream roller in contact with the side P1 connected to the sheet member P sandwiched by the upstream roller pair is the driving side, and thus is not limited to the above.

In the folding apparatus 100 according to the second exemplary embodiment, the transport destination of the sheet member P is changed according to the folding form of the sheet member P. For example, the side in contact with the side P1 connected to the sheet member P sandwiched by the folding roller pair 74 as the upstream roller pair is set as the driving side of the downstream roller pair 86.

Figure 13:
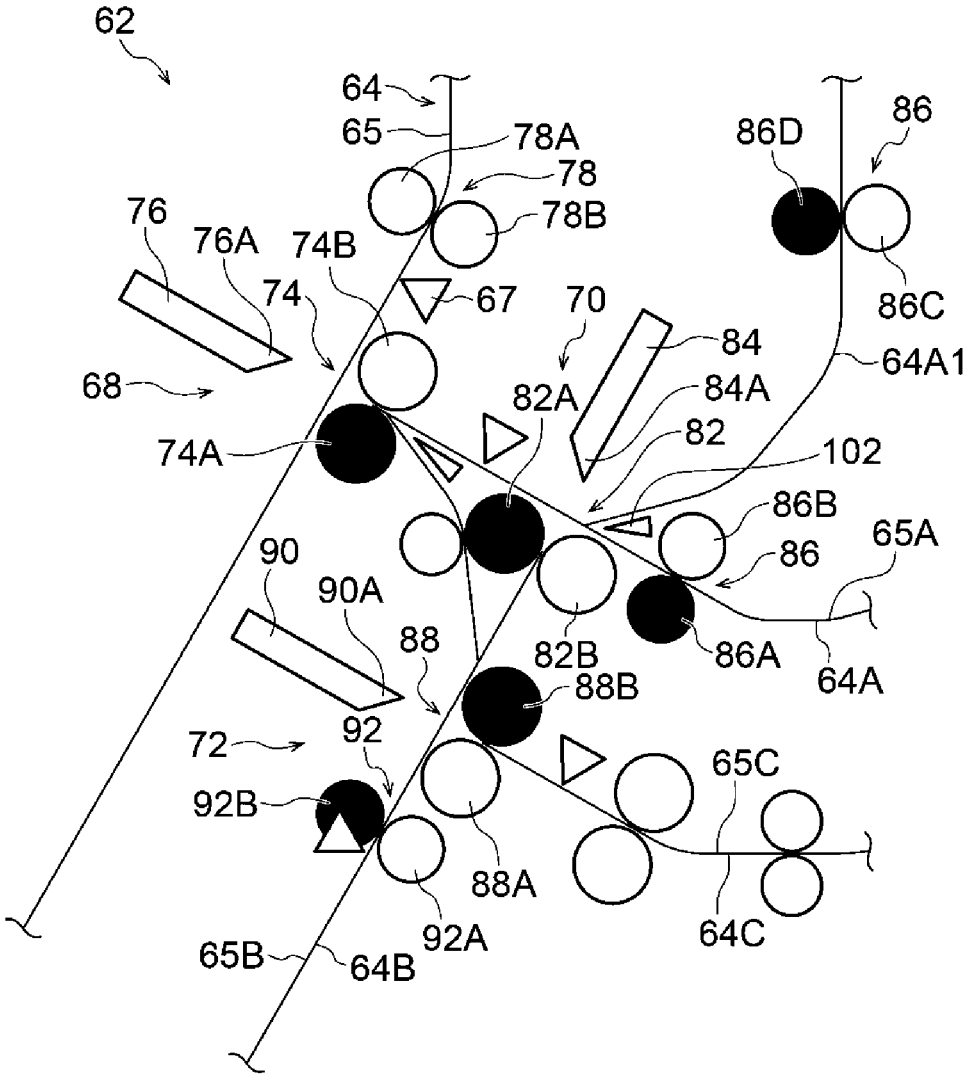
FIG. 13 is an enlarged view illustrating a folding unit of the folding apparatus according to the modification of the first exemplary embodiment in an enlarged manner.

Specifically, the present exemplary embodiment is provided with, for example, a branch path 64A1 that branches from the transport path 64A in which the sheet member P folded once by the folding roller pair 74 is transported, as illustrated in FIGS. 12 and 13. A switching unit 102 is provided at a branch point of the branch path 64A1, and the transport destination of the sheet member P folded once is switched to the transport path 64A or the branch path 64A1 via the switching unit 102 by the user selecting the folding style.

Figure 14A:
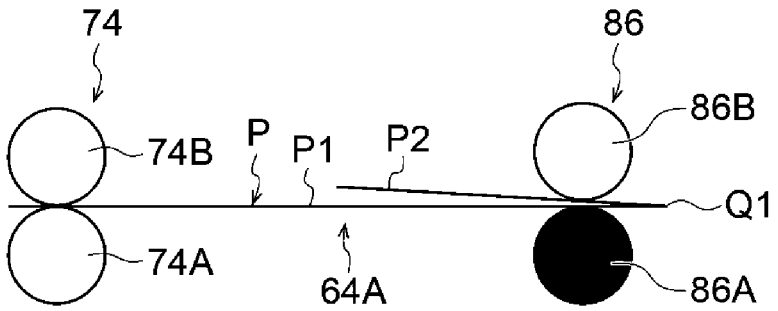
FIG. 14A is an enlarged view illustrating an operation of the folding apparatus according to the modification of the first exemplary embodiment in a case where a recording medium whose folded side is an upper side is transported with a main part thereof enlarged.
Figure 14B:
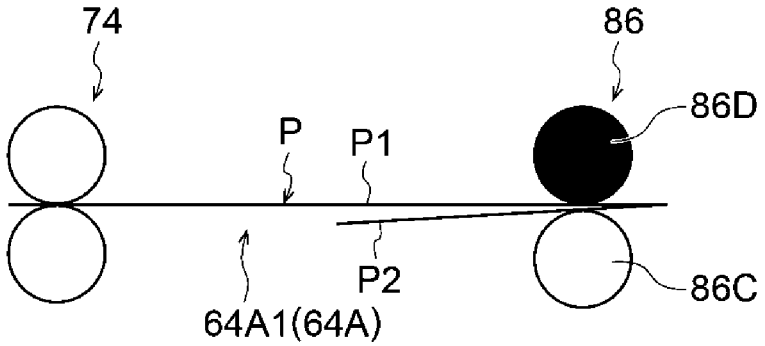
FIG. 14B is an enlarged view illustrating an operation of the folding apparatus according to the modification of the first exemplary embodiment in a case where a recording medium whose folded side is a lower side is transported with a main part thereof enlarged.

FIG. 14A illustrates the transport path 64A side, and FIG. 14B illustrates the branch path 64A1 side.

As illustrated in FIG. 14A, in the transport path 64A, in the downstream roller pair 86, the downstream roller 86A side is the driving roller, and the transport force is applied to the sheet member P by driving the downstream roller 86A.

On the other hand, as shown in FIG. 14B, in the branch path 64A1, the downstream roller pair 86 includes a downstream roller 86C and a downstream roller 86D. The downstream roller 86D side is a driving roller, and a transport force is applied to the sheet member P by driving the downstream roller 86D.

Here, depending on the folding form, the sheet member P may have the upper side of the sheet member P as the folded side P2 as illustrated in FIG. 14A, or may have the lower side of the sheet member P the folded side P2 as illustrated in FIG. 14B.

Therefore, the present exemplary embodiment is provided with the branch path 64A1 that branches from the transport path 64A in which the sheet member P folded once is transported. According to the folding form, it is possible to switch the transport destination of the sheet member P to either the transport path 64A side provided with the downstream roller pair 86 in which the downstream roller 86A is the driving side, or the branch path 64A1 side provided with the downstream roller pair 86 in which the downstream roller 86D is the driving side.

As described above, in the present exemplary embodiment, the transport destination of the sheet member P is switched according to the folding form, and the roller on the driving side comes into contact with the side P1 connected to the sheet member P sandwiched by the upstream roller pair. Thereby, switching control is easier as compared to a configuration that switches between driving and driven by one roller pair.

Third Exemplary Embodiment

An operation of the folding apparatus 14 according to a third exemplary embodiment will be described.

As illustrated in FIG. 3, in the image forming apparatus 10 including the folding apparatus 14 according to the present exemplary embodiment, when a user selects not to perform folding process, the transport route 63 is selected in the folding apparatus 14, and the sheet member P formed with the image and discharged from the image forming apparatus main body 12 is discharged to the outside of the folding apparatus 14.

On the other hand, when the user selects to perform the folding process, the transport route 65 is selected in the folding apparatus 14, and the sheet member P discharged from the image forming apparatus main body 12 is subjected to the folding process.

For example, as illustrated in FIG. 10B, a case in which the sheet member P is subjected to gates folding (folded three times) will be described with reference to FIGS. 3 and 15 to 18.

As shown in FIG. 3, the sheet member P transported by the transport path 64 constituting the transport route 65 is guided toward the guide 80 provided on the downstream side in the transport direction of the sheet member P with respect to the first folding unit 68, and the leading end of the sheet member P abuts against the abutment portion 80A of the guide 80. As a result, the leading ends of the sheet members P are aligned.

Figure 15:
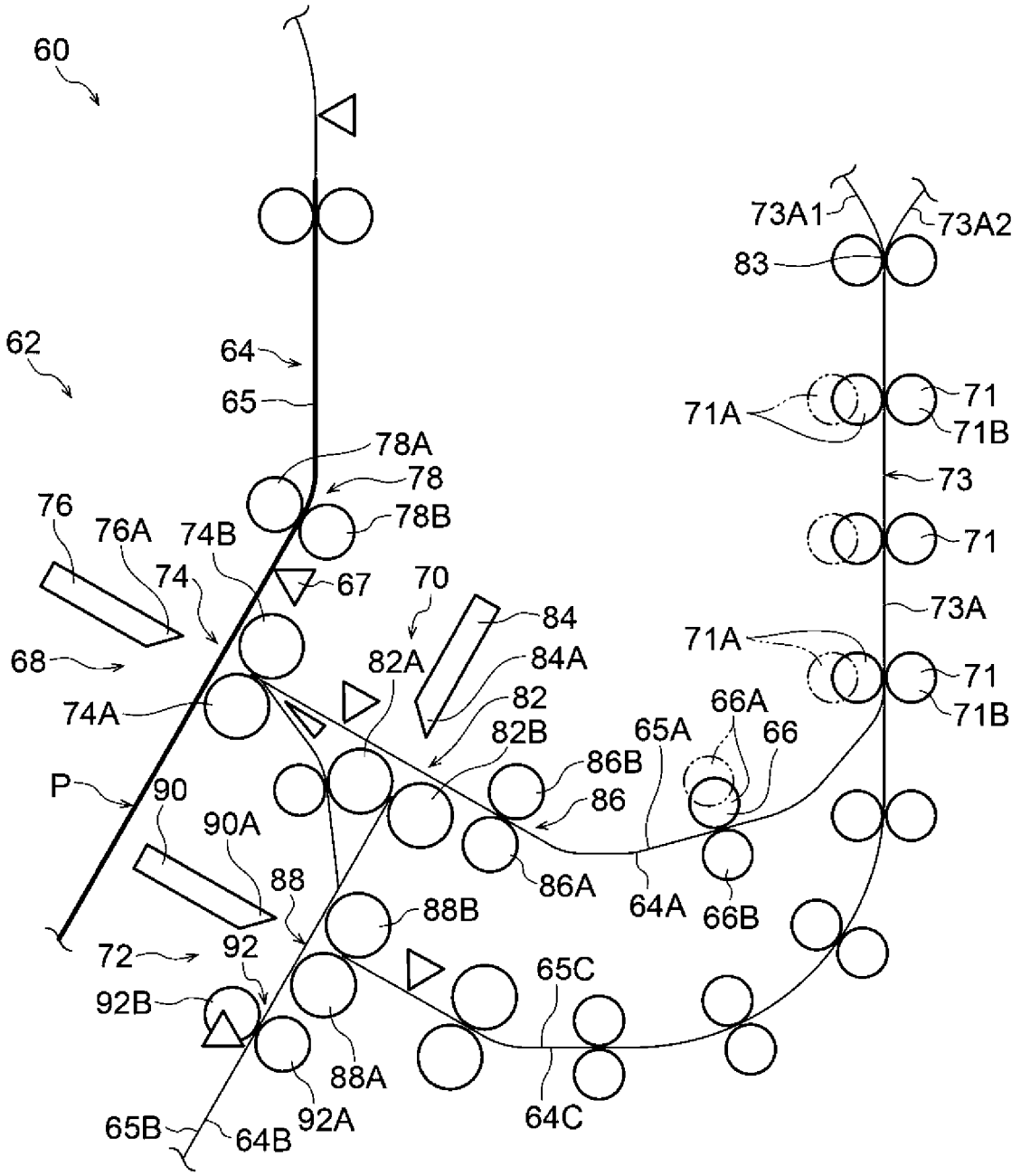
FIG. 15 is an enlarged view illustrating an operation of a first folding unit of a folding apparatus according to a third exemplary embodiment with a main part thereof enlarged.

In this state, as illustrated in FIG. 15, the sheet member P is subjected to a first folding process in the first folding unit 68 (the sheet member P is folded). In the first folding unit 68, the pressing member 76 approaches the transport path 64, and the sheet member P is pressed into between the folding roller 74A and the folding roller 74B by the leading end portion 76A of the pressing member 76.

At this time, in the folding roller pair 74, the folding roller 74A is driven, and the transport force is applied to the sheet member P by driving the folding roller 74A. The sheet member P passes between the folding roller 74A and the folding roller 74B in a state of being folded from the part (folding target position) of the sheet member P. As a result, the fold Q1 (see FIG. 16) is created on the sheet member P, and the sheet member P is transported to the transport path 64A with the fold Q1 at the leading end.

Figure 16:
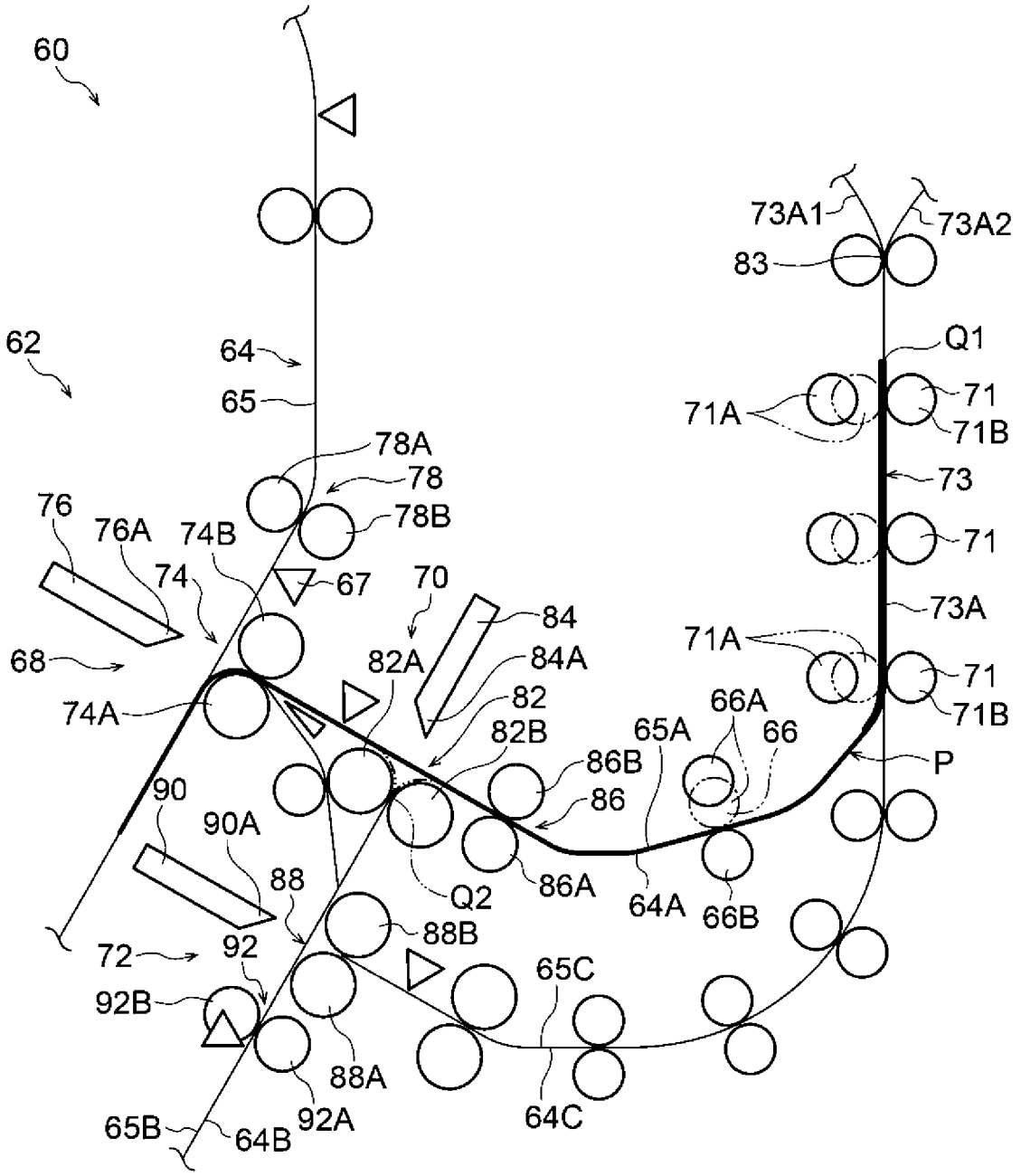
FIG. 16 is an enlarged view illustrating an operation of a transport roller pair provided on a leading end side of a recording medium when the recording medium is to be folded by a second folding unit serving as a folding unit of the folding apparatus according to the third exemplary embodiment with a main part thereof enlarged.

Next, as illustrated in FIG. 16, the sheet member P on which the fold Q1 is created is subjected to a second folding process in the second folding unit 70. The second folding unit 70 is provided with the folding roller pair 74 as an upstream roller pair at the upstream side in the transport direction by the second folding unit 70, and is provided with the downstream roller pair 86 at the downstream side in the transport direction by the second folding unit 70.

The sheet member P is sandwiched by the folding roller pair 74 and the downstream roller pair 86. On the other hand, the leading end (fold Q1) of the sheet member P is transported toward the transport path 73A.

Here, in the present exemplary embodiment, in the transport path 64A, the transport roller 66A can come into contact with and separate from the transport roller 66B, and in the transport path 73A, the transport roller 71A can come into contact with and separate from the transport roller 71B. Therefore, in the present exemplary embodiment, when the second folding process is to be performed in the second folding unit 70, as illustrated by the solid line in FIG. 16, the transport roller 66A is separated from the transport roller 66B, and the transport roller 71A is separated from the transport roller 71B (so-called nip release state).

The sheet member P is sandwiched by the folding roller pair 74 as the upstream roller pair and the downstream roller pair 86, and in this state, the pressing member 84 approaches the transport path 64A, and the leading end portion 84A of the pressing member 84 is pressed into between the folding roller 82A and the folding roller 82B via the sheet member P.

On the other hand, in a state in which the sheet member P is pressed into between the folding roller 82A and the folding roller 82B by the leading end portion 84A of the pressing member 84, the transport force is applied to the sheet member P by driving the folding roller pair 82.

The sheet member P passes between the folding roller 82A and the folding roller 82B in a state of being folded from said another part (folding target position) of the sheet member P. As a result, in addition to the fold Q1, the fold Q2 is created on the sheet member P, and the sheet member P is transported to the transport path 64B with the fold Q2 at the leading end.

Further, the sheet member P on which the folds Q1, Q2 are created is subjected to the third folding process in the third folding unit 72. The third folding unit 72 is provided with the folding roller pair 82 as an upstream roller pair at the upstream side in the transport direction by the third folding unit 72, and is provided with the downstream roller pair 92 at the downstream side in the transport direction by the third folding unit 72.

The sheet member P is sandwiched by the folding roller pair 82 as the upstream roller pair and the downstream roller pair 92, and in this state, the pressing member 90 approaches the transport path 64B, and the leading end portion 90A of the pressing member 90 is pressed into between the folding roller 88A and the folding roller 88B via the sheet member P.

On the other hand, in a state in which the sheet member P on which the folds Q1, Q2 are created is pressed into between the folding roller 88A and the folding roller 88B by the leading end portion 90A of the pressing member 90, the transport force is applied by driving the folding roller pair 88.

Figure 17:
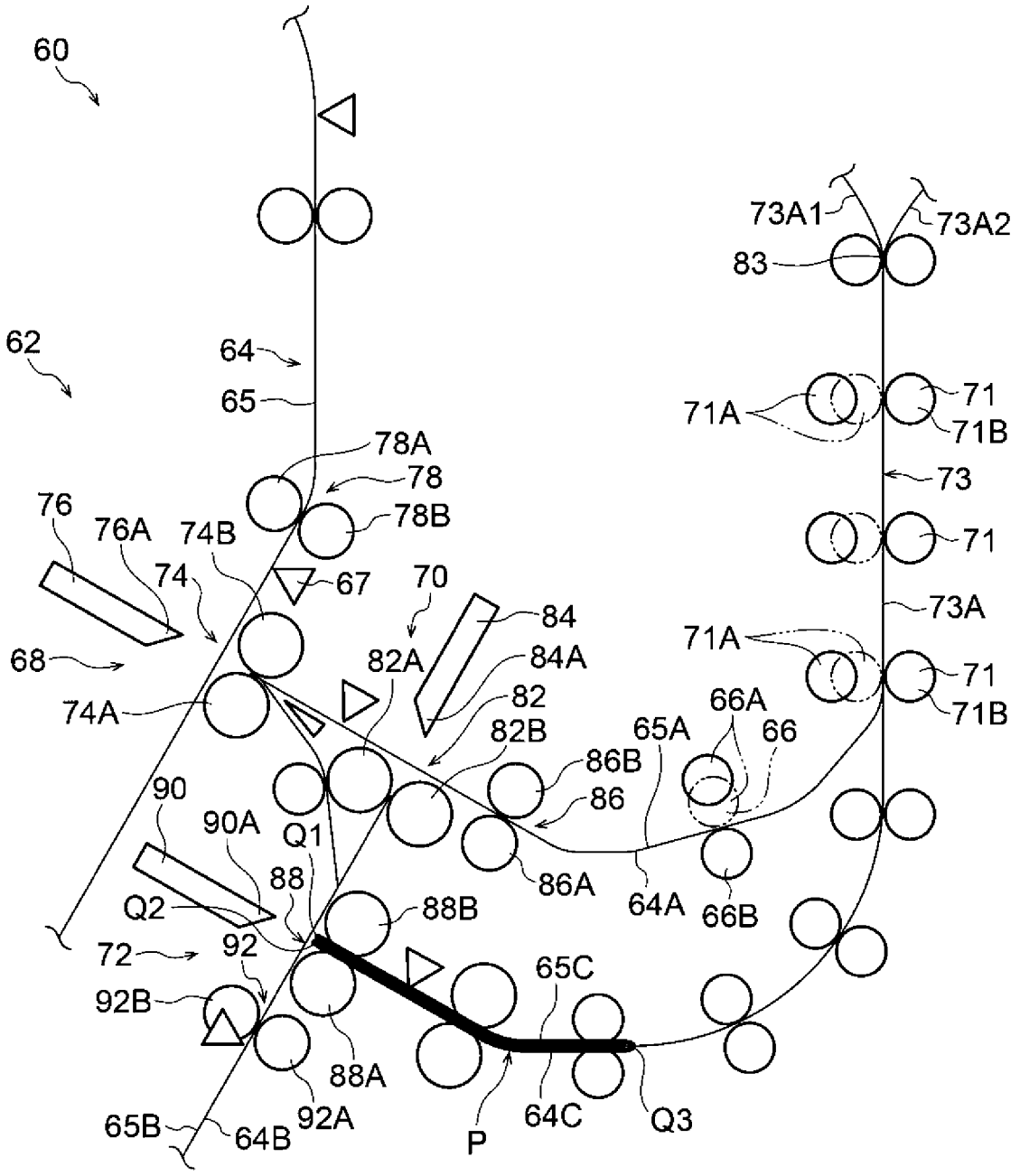
FIG. 17 is an enlarged view illustrating an operation of a third folding unit serving as the folding unit of the folding apparatus according to the third exemplary embodiment with a main part thereof enlarged.

The sheet member P passes between the folding roller 88A and the folding roller 88B in a state of being folded from the still another part (Q3) of the sheet member P. As a result, as illustrated in FIG. 17, in addition to the folds Q1, Q2, the fold Q3 is created on the sheet member P, and the sheet member P is transported to the transport path 64C with the fold Q3 at the leading end. In this way, the sheet member P is subjected to gates folding (see FIG. 10B).

Figure 18:
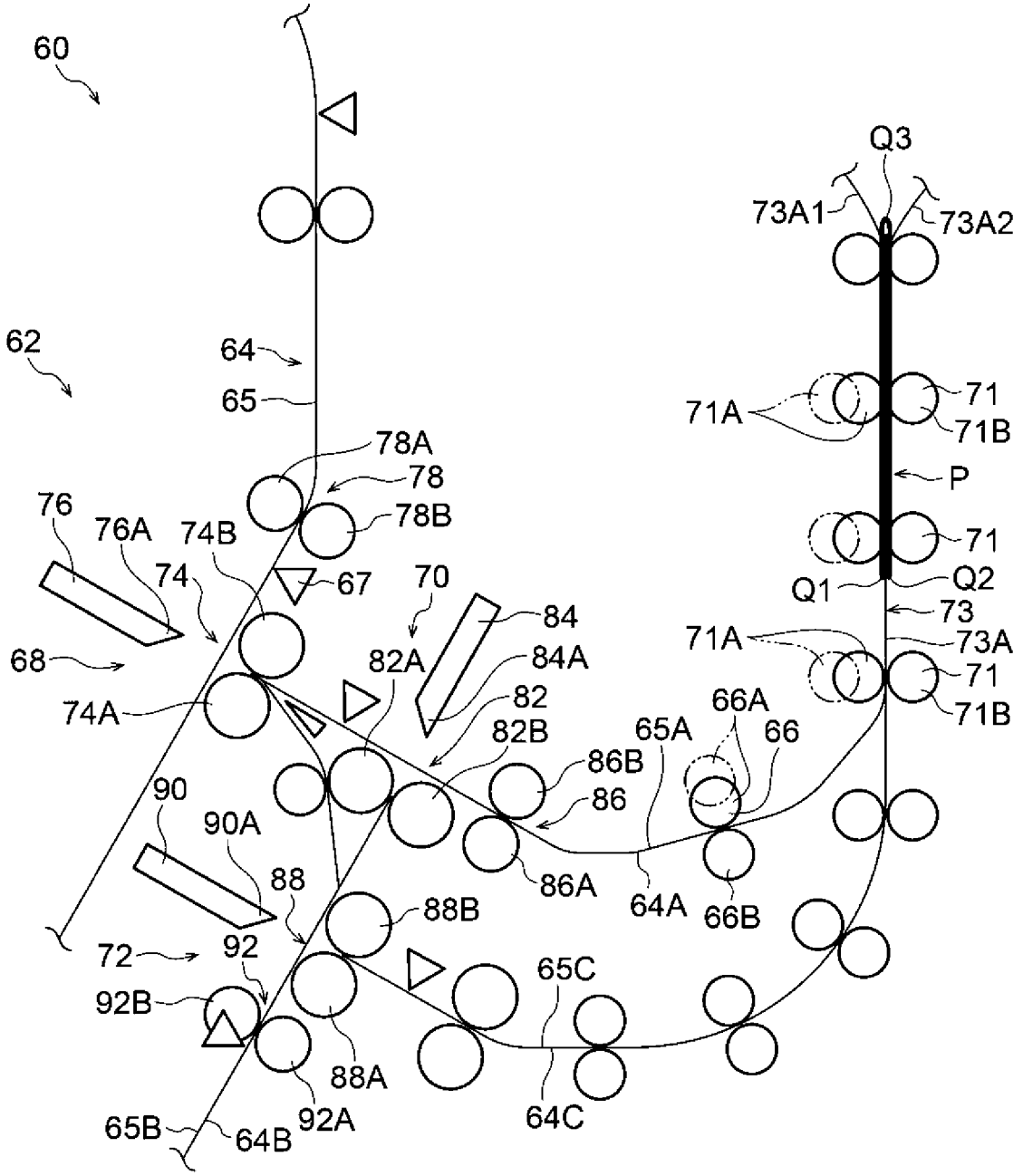
FIG. 18 is an enlarged view illustrating an operation of a transport unit that transports to the outside of the folding apparatus according to the third exemplary embodiment with a main part thereof enlarged.

Then, as illustrated in FIG. 18, the sheet member P subjected to gates folding is transported from the transport path 64C to the transport path 73, and is transported to the outside of the folding apparatus 14 (see FIG. 3). At this time, in the transport path 73A, as indicated by the solid line, the transport roller 71A can come into contact with the transport roller 71B, and the sheet member P is transported by the transport roller pair 71 in a nipped state.

In the present exemplary embodiment, the folding unit 62 for folding the sheet member P is provided at three positions (the first folding unit 68, the second folding unit 70, and the third folding unit 72). As a result, in the present exemplary embodiment, the sheet member P can be folded three times, and the folding forms are increased as compared to the case where the number of folding units is two or less.

Here, as the folding forms, for example, the case where the sheet member P is folded twice is exemplified by the Z-folding shown in FIG. 11A, the inner three-folding shown in FIG. 11B, the outer three-folding shown in FIG. 11C, and the four-folding shown in FIG. 11D. On the other hand, the case where the sheet member P is folded three times is exemplified by the bellows folding illustrated in FIG. 10A, in addition to the gates folding illustrated in FIG. 10B. In other words, in the present exemplary embodiment, it is possible to perform the gates folding, the bellows folding, and the like of the sheet member P, which cannot be performed in the case where the number of folding units is two or less.

In general, in a configuration that transports a sheet member folded plural times, for example, a two-folded sheet member P folded once has a dimension longer than a roller pitch, and thus is sandwiched between the plural transport roller pairs 71 and bears the transport force. As a result, wrinkles, bending or the like may occur to the sheet member P, and the accuracy with respect to the folding position of the sheet member P may be lowered.

Therefore, in the present exemplary embodiment, as illustrated in FIGS. 16 and 18, in the transport roller pair 71 constituting the transport path 73, the transport roller 71A can come into contact with and separate from the transport roller 71B, and can between the nip state and the nip release state with respect to the sheet member P.

As a result, as illustrated in FIG. 16, when the second folding process is to be performed in the second folding unit 70, the transport roller 71A is separated from the transport roller 71B, and comes into the nip release state. Therefore, in the present exemplary embodiment, the accuracy with respect to the folding position of the sheet member P is improved as compared to a configuration in which the transport roller pair 71 is always in the nip state.

On the other hand, when the folded sheet member P is to be transported to the outside of the folding apparatus 14 (see FIG. 3) as illustrated in FIG. 18, including transport to another processing unit, such as a post-processing device that performs bookbinding such as a binding process, in the transport path 73A, the transport roller 71A can come into contact with the transport roller 71B, and the sheet member P is transported by the transport roller pair 71 in a nip state.

That is, in the present exemplary embodiment, the transport path 73A used as a space for releasing the sheet member P when the sheet member P is to be folded also servers as a discharge path for transporting the sheet member P to the outside of the folding apparatus 14. As a result, in the present exemplary embodiment, it is possible to reduce the size of the folding apparatus 14, as compared to a configuration provided with a dedicated space for releasing the sheet member P when the sheet member P is to be folded.

In the present exemplary embodiment, as illustrated in FIG. 16, all (three in this example) the transport roller pairs 71 constituting the transport path 73A are in the nip release state. However, since the position of the leading end of the sheet member P changes depending on the folding form of the sheet member P or the size of the sheet member P, the number of the transport roller pairs 71 that are released from nip can be changed according to the folding form of the sheet member P or the size of the sheet member P.

Figure 19:
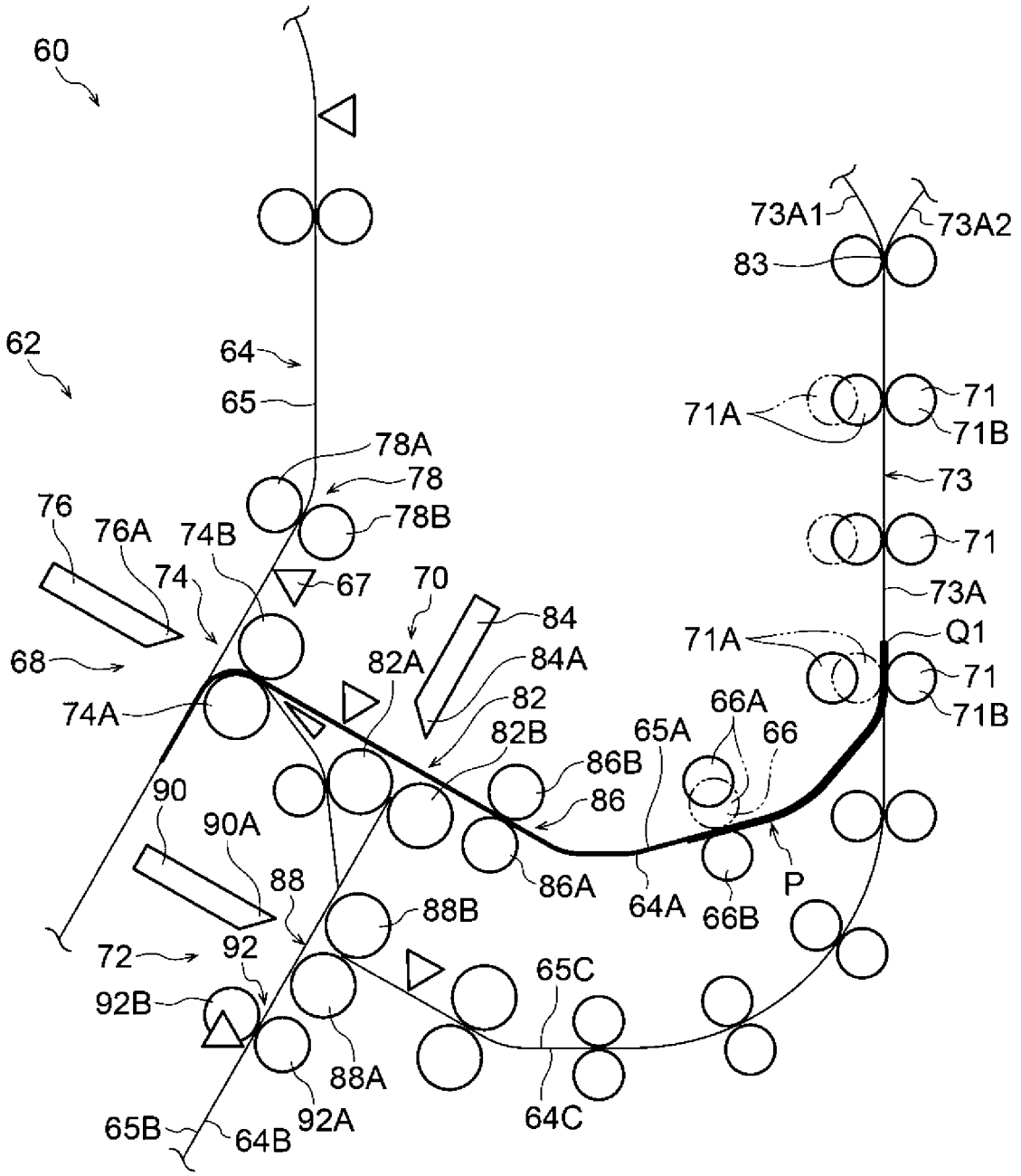
FIG. 19 is an enlarged view corresponding to FIG. 16 for illustrating an operation of a transport roller pair as a modification with a main part thereof enlarged.

For example, as a modification, in a case where the size of the sheet member P is small as illustrated in FIG. 19, an entry amount of the sheet member P in the transport path 73A is shorter than that in the case illustrated in FIG. 16. Therefore, here, in the transport roller pair 71 on the downstream roller pair 86 side (one here), the transport roller 71A separates from the transport roller 71B (nip release state), and in the transport roller pairs 71 of the branch portion 83 (two in this case), the transport roller 71A can come into contact with the transport roller 71B (nipped state).

That is, when the sheet member P is to be folded by the second folding unit 70, only the necessary transport roller pairs are set in the nip release state in the transport paths 64A and 73A used to release the sheet member P. As a result, in the present exemplary embodiment, power consumption is reduced as compared to a case in which all the transport roller pairs 71 are in the nip release state when the sheet member P is to be folded by the second folding unit 70.

Fourth Exemplary Embodiment

An operation of the folding apparatus 14 according to a fourth exemplary embodiment will be described.

As illustrated in FIG. 3, in the image forming apparatus 10 including the folding apparatus 14 according to the present exemplary embodiment, when a user selects not to perform folding process, the transport route 63 is selected in the folding apparatus 14, and the sheet member P formed with the image and discharged from the image forming apparatus main body 12 is discharged to the outside of the folding apparatus 14.

On the other hand, when the user selects to perform the folding process, the transport route 65 is selected in the folding apparatus 14, and the sheet member P discharged from the image forming apparatus main body 12 is subjected to the folding process.

For example, as illustrated in FIG. 10B, a case in which the sheet member P is subjected to gates folding (folded three times) will be described with reference to FIGS. 3 and 21 to 25. The sheet member P shown in FIGS. 21 to 24 is shown with a larger thickness of the sheet member P, so that the folded state of the sheet member P can be understood.

As shown in FIG. 3, the sheet member P transported by the transport path 64 constituting the transport route 65 is guided toward the guide 80 provided on the downstream side in the transport direction of the sheet member P with respect to the first folding unit 68, and the leading end of the sheet member P abuts against the abutment portion 80A of the guide 80. As a result, the leading end of the sheet member P is positioned.

Figure 21:
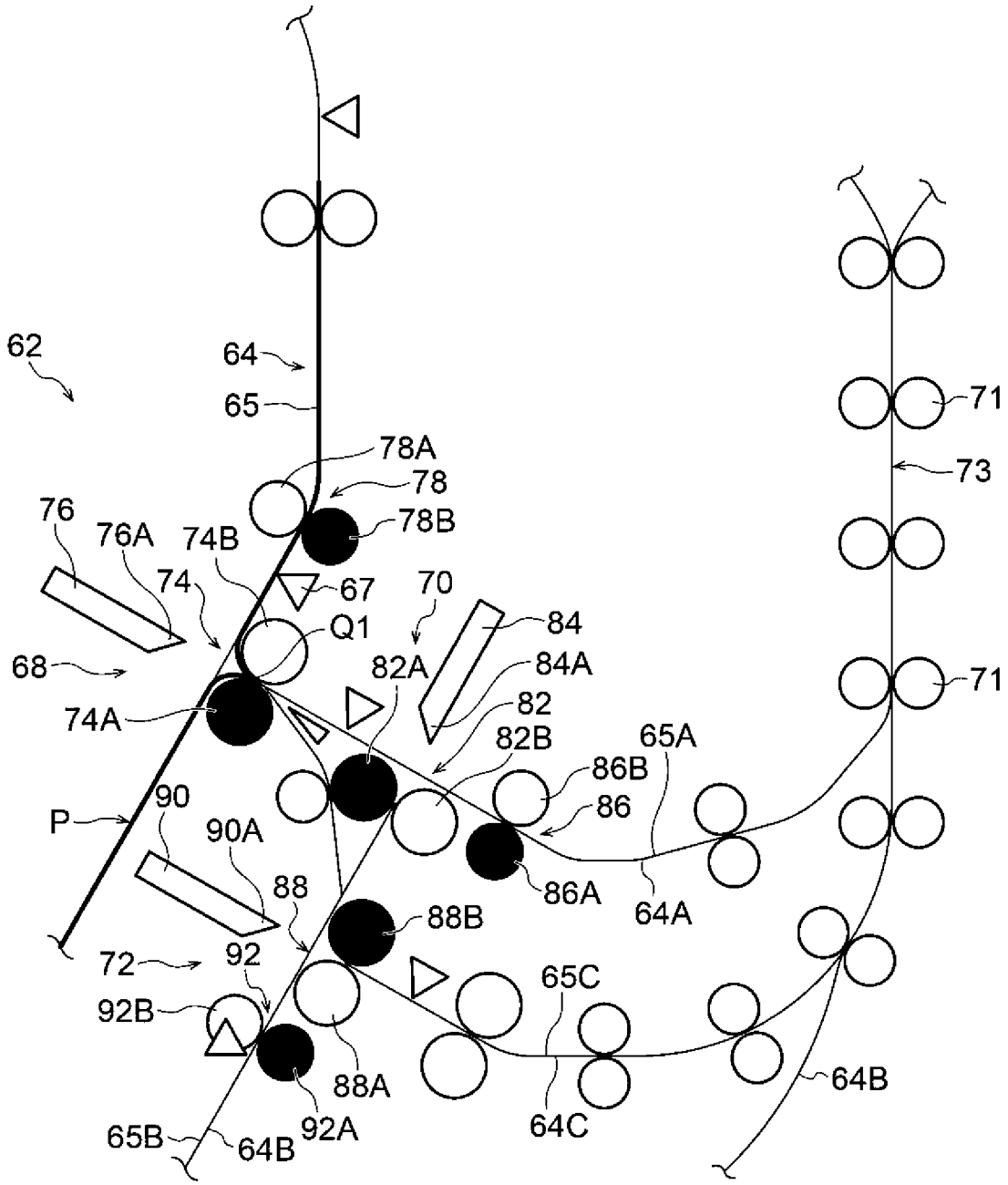
FIG. 21 is an enlarged view illustrating an operation of a first folding unit serving as an upstream folding unit of the folding apparatus according to the fourth exemplary embodiment.

In this state, as illustrated in FIG. 21, the sheet member P is subjected to a first folding process in the first folding unit 68 (the sheet member P is folded). In the first folding unit 68, the pressing member 76 approaches the transport path 64, and the sheet member P is pressed into between the folding roller 74A and the folding roller 74B by the leading end portion 76A of the pressing member 76.

At this time, among the folding roller pair 74, the folding roller 74A is driven, and in a state in which the sheet member P is pressed into between the folding roller 82A and the folding roller 82B by the leading end portion 76A of the pressing member 76, the transport force is applied to the sheet member P by driving the folding roller 74A.

The sheet member P passes between the folding roller 74A and the folding roller 74B in a state of being folded from the part (folding target position) of the sheet member P. As a result, the fold Q1 is created on the sheet member P, and the sheet member P is transported to the transport path 64A with the fold Q1 at the leading end.

Figure 22:
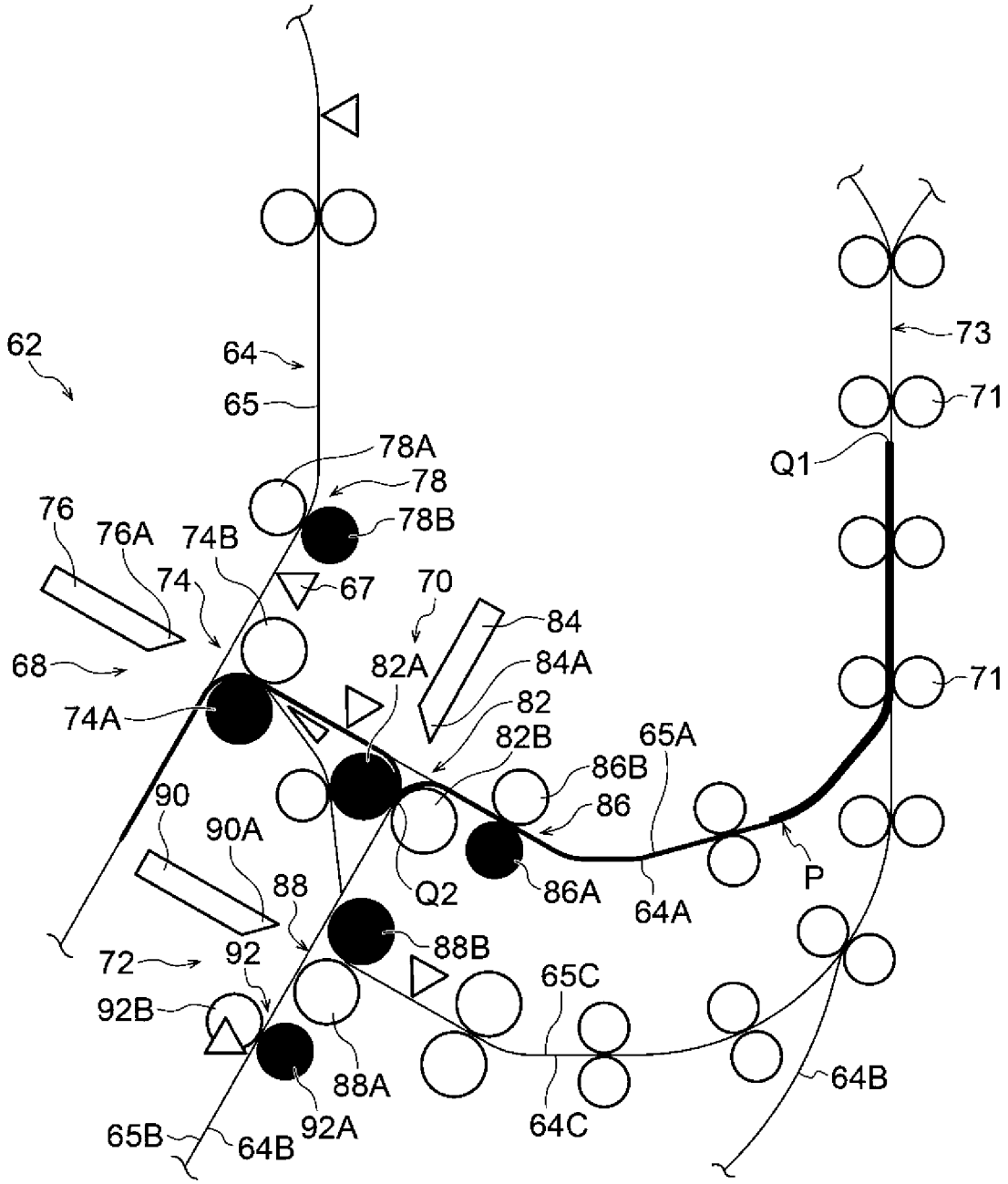
FIG. 22 is an enlarged view illustrating an operation of a second folding unit serving as a folding unit of the folding apparatus according to the fourth exemplary embodiment with a main part thereof enlarged.

Next, as illustrated in FIG. 22, the sheet member P on which the fold Q1 is created is subjected to a second folding process in the second folding unit 70. The second folding unit 70 is provided with the folding roller pair 74 as an upstream roller pair at the upstream side in the transport direction by the second folding unit 70, and is provided with the downstream roller pair 86 at the downstream side in the transport direction by the second folding unit 70.

Here, in the second folding unit 70, the sheet member P is sandwiched by the folding roller pair 74 as the upstream roller pair and the downstream roller pair 86.

In a control mode by a control unit 102 (see FIG. 25) in the present exemplary embodiment, driving of motors 100 and 101 (see FIG. 25) is stopped at a position where said another part (folding target position) of the sheet member P faces the leading end portion 84A of the pressing member 84. As a result, the folding roller 82A, the folding roller 74A as the upstream roller pair, and the downstream roller 86A stop rotating.

When the pressing member 84 approaches the transport path 64A and a movement amount of the pressing member 84 detected by a movement amount detection sensor 104 (see FIG. 25) reaches a predetermined movement amount, that is, when the leading end portion 84A of the pressing member 84 abuts against the folding roller pair 82 via the sheet member P, the motors 100 and 101 are driven, and the folding roller 82A, the folding roller 74A as the upstream roller pair, and the downstream roller 86A start to rotate at the same timing.

As illustrated in FIG. 22, in a state in which the sheet member P on which the fold Q1 is created is pressed into between the folding roller 82A and the folding roller 82B by the leading end portion 84A of the pressing member 84, the transport force is applied to the sheet member P by driving the folding roller 82A. In this state, the leading end portion 84A of the pressing member 84 further moves toward the folding roller pair 82, and the sheet member P is sandwiched by the folding roller 82A and the folding roller 82B. When a drive current of the motor 100 increases, the pressing member 84 retreats from the transport path 64A.

The sheet member P passes between the folding roller 82A and the folding roller 82B in a state of being folded from said another part (folding target position) of the sheet member P. As a result, in addition to the fold Q1, the fold Q2 is created on the sheet member P, and the sheet member P is transported to the transport path 64B with the fold Q2 at the leading end.

Figure 23:
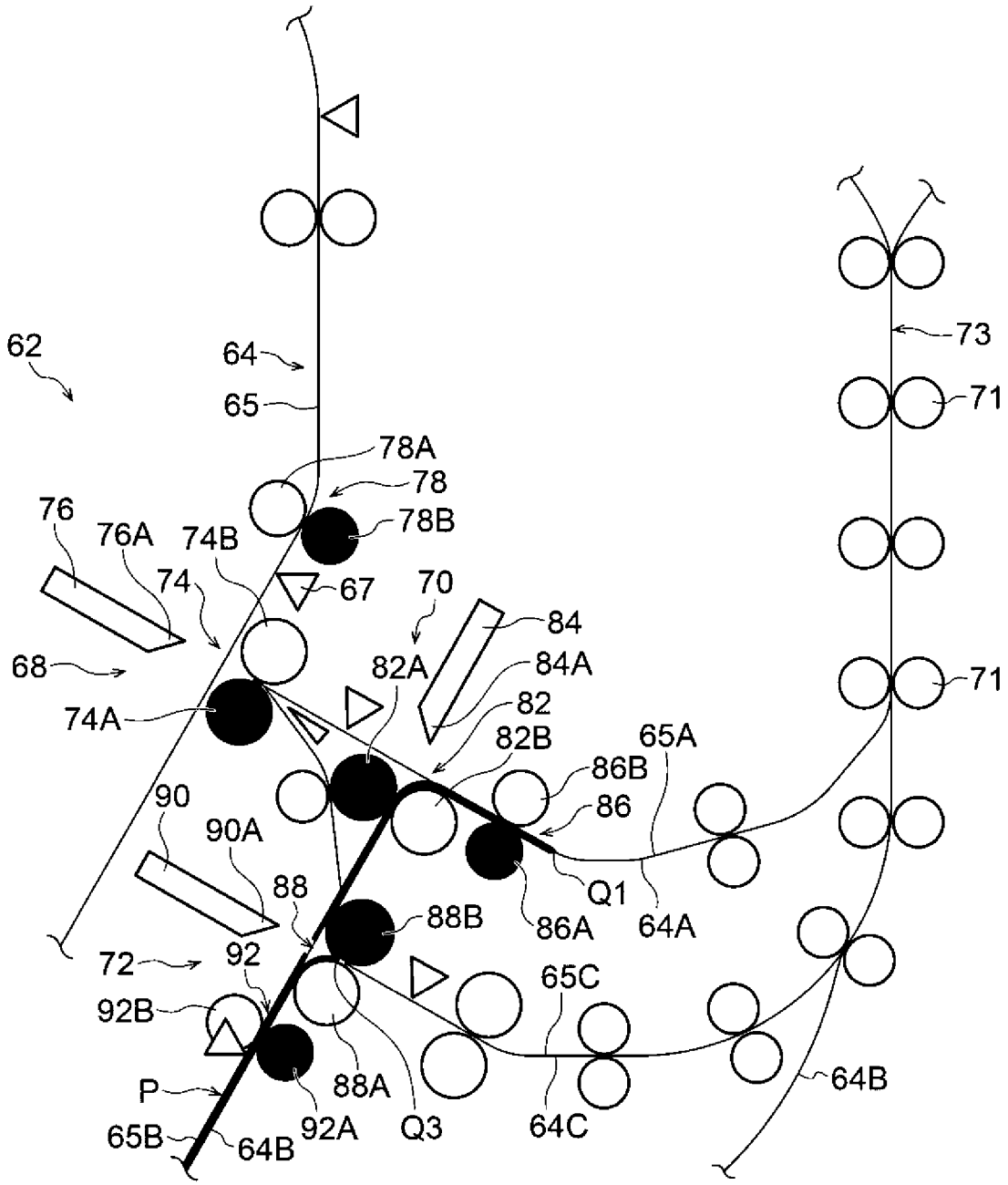
FIG. 23 is an enlarged view illustrating an operation of a third folding unit serving as a downstream folding unit of the folding apparatus according to the fourth exemplary embodiment with a main part thereof enlarged.

Further, as illustrated in FIG. 23, the sheet member P on which the folds Q1, Q2 are created is subjected to a third folding process in the third folding unit 72. The third folding unit 72 is provided with the folding roller pair 82 as an upstream roller pair at the upstream side in the transport direction by the third folding unit 72, and is provided with the downstream roller pair 92 at the downstream side in the transport direction by the third folding unit 72.

Here, in the third folding unit 72, the sheet member P is sandwiched by the folding roller pair 82 as the upstream roller pair and the downstream roller pair 92.

In a control mode by the control unit 102 (see FIG. 25) in the present exemplary embodiment, driving of motors 106 and 107 (see FIG. 25) is stopped at a position where the still another part (folding target position) of the sheet member P faces the leading end portion 90A of the pressing member 90. As a result, the folding roller 88B, the folding roller 82A as the upstream roller pair, and the downstream roller 92A stop rotating.

When the pressing member 90 approaches the transport path 64B and a movement amount of the pressing member 90 detected by a movement amount detection sensor 108 (see FIG. 25) reaches a predetermined movement amount, that is, when the leading end portion 90A of the pressing member 90 abuts against the folding roller pair 88 via the sheet member P, the motors 106 and 107 are driven, and the folding roller 88B, the folding roller 82A as the upstream roller pair, and the downstream roller 92A start to rotate at the same timing.

As illustrated in FIG. 22, in a state in which the sheet member P on which the fold Q2 is created is pressed into between the folding roller 88A and the folding roller 88B by the leading end portion 90A of the pressing member 90, the transport force is applied to the sheet member P by driving the folding roller 88B. In this state, the leading end portion 90A of the pressing member 90 further moves toward the folding roller pair 88, and the sheet member P is sandwiched by the folding roller 88A and the folding roller 88B. When a drive current of the motor 106 increases, the pressing member 90 retreats from the transport path 64B.

Figure 24:
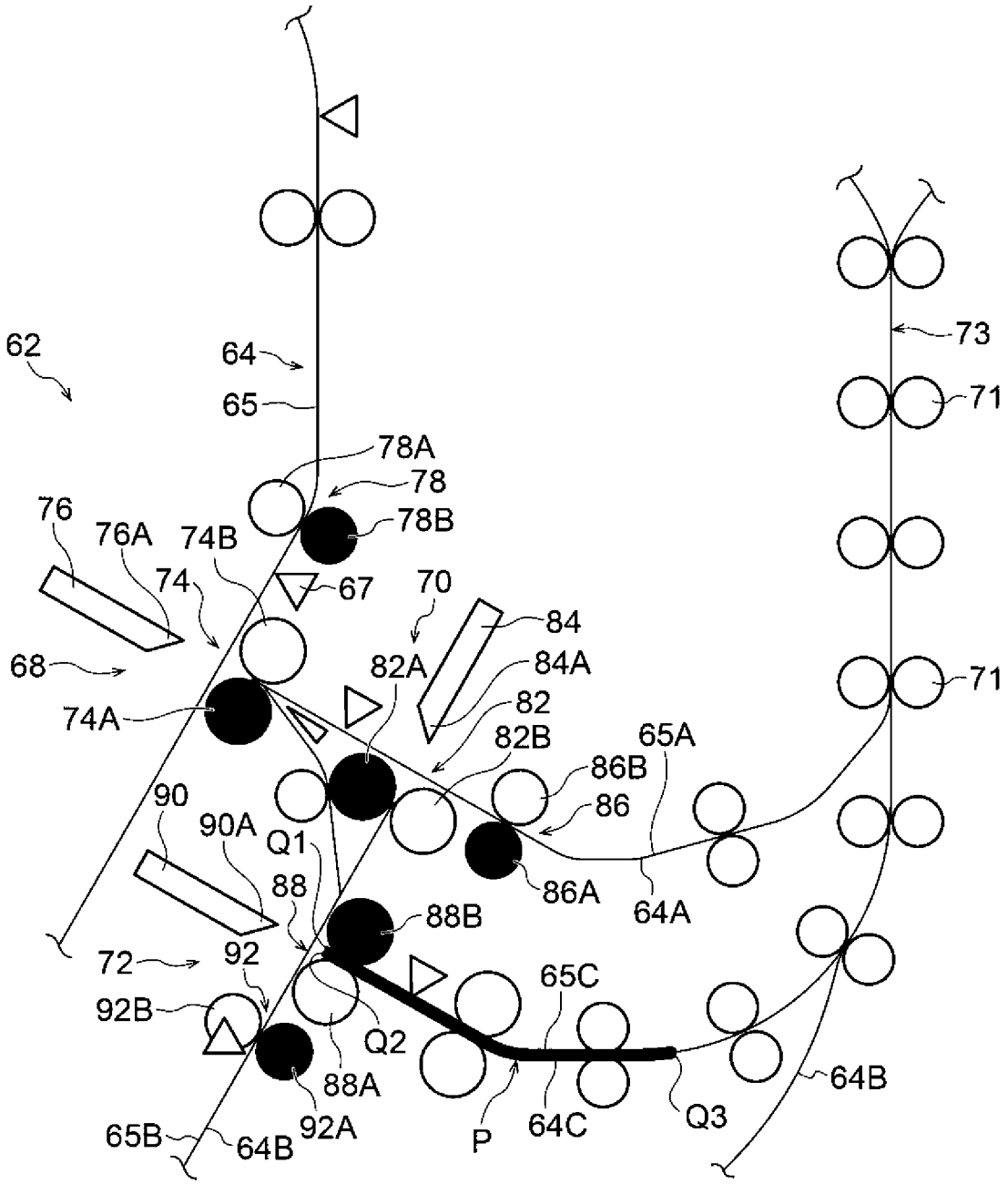
FIG. 24 is an enlarged view illustrating an operation of the third folding unit serving as the downstream folding unit of the folding apparatus according to the fourth exemplary embodiment with a main part thereof enlarged.

The sheet member P passes between the folding roller 88A and the folding roller 88B in a state of being folded from the still another part (folding target position) of the sheet member P. As a result, as illustrated in FIG. 24, in addition to the folds Q1, Q2, the fold Q3 is created on the sheet member P, and the sheet member P is transported to the transport path 64C with the fold Q3 at the leading end. In this way, the sheet member P is subjected to gates folding.

In the present exemplary embodiment, when the sheet member P is to be folded by the second folding unit 70 and the third folding unit 72, the sheet member P is sandwiched by the upstream roller pair provided on the upstream side along the transport direction of the sheet member P with respect to the folding roller pair and the downstream roller pair provided on the downstream side along the transport direction of the sheet member P with respect to the folding roller pair.

As a comparative example, in a case where the folding roller pair rotates when the sheet member P is pressed toward the folding roller pair by the pressing member, if the folding roller, the upstream roller pair, and the downstream roller pair are not synchronized with each other, the accuracy of the folding position of the sheet member P may be deteriorated, and damage such as wrinkles may occur to the sheet member P.

Figure 25:
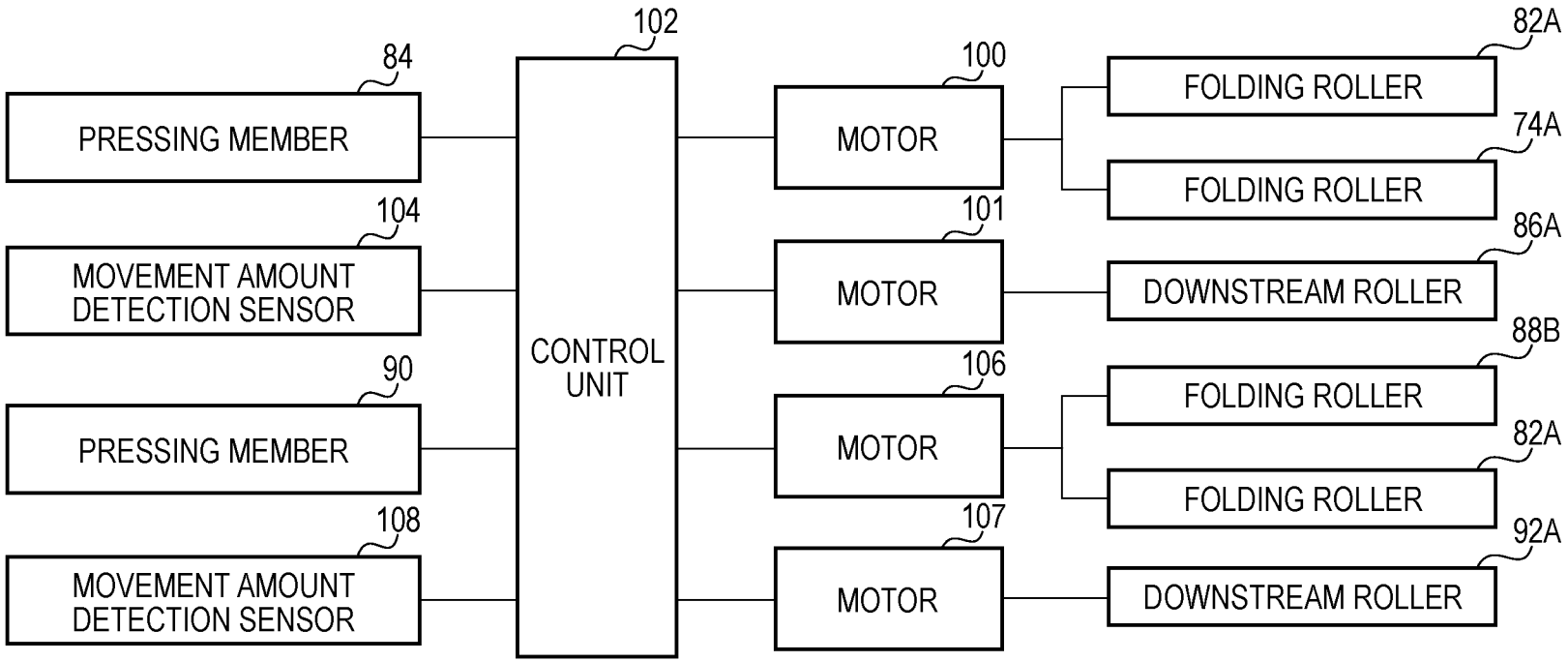
FIG. 25 is a block diagram illustrating a configuration of a control unit that controls the folding unit of the folding apparatus according to the fourth exemplary embodiment.

In contrast, in the control mode by the control unit 102 (see FIG. 25) in the present exemplary embodiment, for example, as illustrated in FIGS. 22 and 25, in the second folding unit 70, driving of the motors 100 and 101 (see FIG. 25) is stopped at the position where said another part (folding target position) of the sheet member P faces the leading end portion 84A of the pressing member 84. As a result, the folding roller 82A, the folding roller 74A as the upstream roller pair, and the downstream roller 86A stop rotating.

When the movement amount of the pressing member 84 detected by the movement amount detection sensor 104 reaches the predetermined movement amount, that is, when the leading end portion 84A of the pressing member 84 abuts against the folding roller pair 82 via the sheet member P, the motors 100 and 101 are driven, and the folding roller 82A, the folding roller 74A as the upstream roller pair, and the downstream roller 86A start to rotate at the same timing.

Accordingly, in the present exemplary embodiment, it is possible to prevent occurrence of wrinkles in the sheet member P as compared to a case in which the sheet member P is pressed into between the folding roller pair 82 by the pressing member 84 while rotating the folding roller pair 82 in the second folding unit 70.

Further, in the present exemplary embodiment, as shown in FIGS. 23 and 25, in the third folding unit 72, driving of the motors 106 and 107 (see FIG. 25) is stopped at the position where the still another part (folding target position) of the sheet member P faces the leading end portion 90A of the pressing member 90. As a result, the folding roller 88B, the folding roller 82A as the upstream roller pair, and the downstream roller 92A stop rotating.

When the movement amount of the pressing member 90 detected by the movement amount detection sensor 108 reaches the predetermined movement amount, that is, when the leading end portion 90A of the pressing member 90 abuts against the folding roller pair 88 via the sheet member P, the motors 106 and 107 are driven, and the folding roller 88B, the folding roller 82A as the upstream roller pair, and the downstream roller 92A start to rotate at the same timing.

Accordingly, in the present exemplary embodiment, it is possible to prevent occurrence of wrinkles in the sheet member P as compared to a case in which the sheet member P is pressed into between the folding roller pair 88 by the pressing member 90 while rotating the folding roller pair 88 in the third folding unit 72.

Here, in the present exemplary embodiment, for example, when the sheet member P is to be folded in the second folding unit 70, that is, when the sheet member P is to be pressed into between the folding roller pair 82 by the pressing member 84, the folding roller pair 82 is not rotated.

Accordingly, in the present exemplary embodiment, it is possible to prevent occurrence of wrinkles in the sheet member P as compared to a case in which the sheet member P is pressed into between the folding roller pair 82 by the pressing member 84 while rotating the folding roller pair 82. The third folding unit 72 is controlled in the same manner as the second folding unit 70.

In the present exemplary embodiment, for example, when the sheet member P is to be folded in the second folding unit 70, the folding roller pair 74 as the upstream roller pair sandwiches the sheet member P. Therefore, when the sheet member P is to be pressed into between the folding roller pair 82 by the pressing member 84, the folding roller pair 82 and the folding roller pair 74 are not rotated.

Accordingly, in the present exemplary embodiment, it is possible to prevent occurrence of wrinkles in the sheet member P as compared to a case in which the sheet member P is pressed into between the folding roller pair 82 by the pressing member 84 while rotating the folding roller pair 74. The third folding unit 72 is controlled in the same manner as the second folding unit 70.

In the present exemplary embodiment, for example, when the sheet member P is to be folded in the second folding unit 70, the downstream roller pair 86 sandwiches the sheet member P. Therefore, when the sheet member P is to be pressed into between the folding roller pair 82 by the pressing member 84, the folding roller pair 82 and the downstream roller pair 86 are not rotated.

Accordingly, in the present exemplary embodiment, it is possible to prevent occurrence of wrinkles in the sheet member P as compared to a case in which the sheet member P is pressed into between the folding roller pair 82 by the pressing member 84 while rotating the folding roller pair 74. The third folding unit 72 is controlled in the same manner as the second folding unit 70.

In the present exemplary embodiment, it is possible to execute a control mode in which when the sheet member P is to be folded in the first folding unit 68 as illustrated in FIG. 21, that is, when the sheet member P is to be pressed into between the folding roller pair 74 by the pressing member 76, rotation of the folding roller pair 74 is not stopped. That is, in the first folding unit 68, the sheet member P is pressed into between the folding roller pair 74 by the pressing member 76 in a state in which the folding roller pair 74 is rotated.

In the first folding unit 68, the sheet member P abuts against the abutment portion 80A of the guide 80 illustrated in FIG. 3, and is in a state in which variation in the folding position by the first folding unit 68 is prevented. Therefore, in the first folding unit 68, it is also possible to form the sheet member P in a state in which the folding roller pair 74 is rotated. In this control mode, productivity is improved as compared to a case of executing a control mode in which the sheet member P is pressed into between the folding roller pair 74 that are always stopped when the sheet member P is to be folded.

Figure 20:
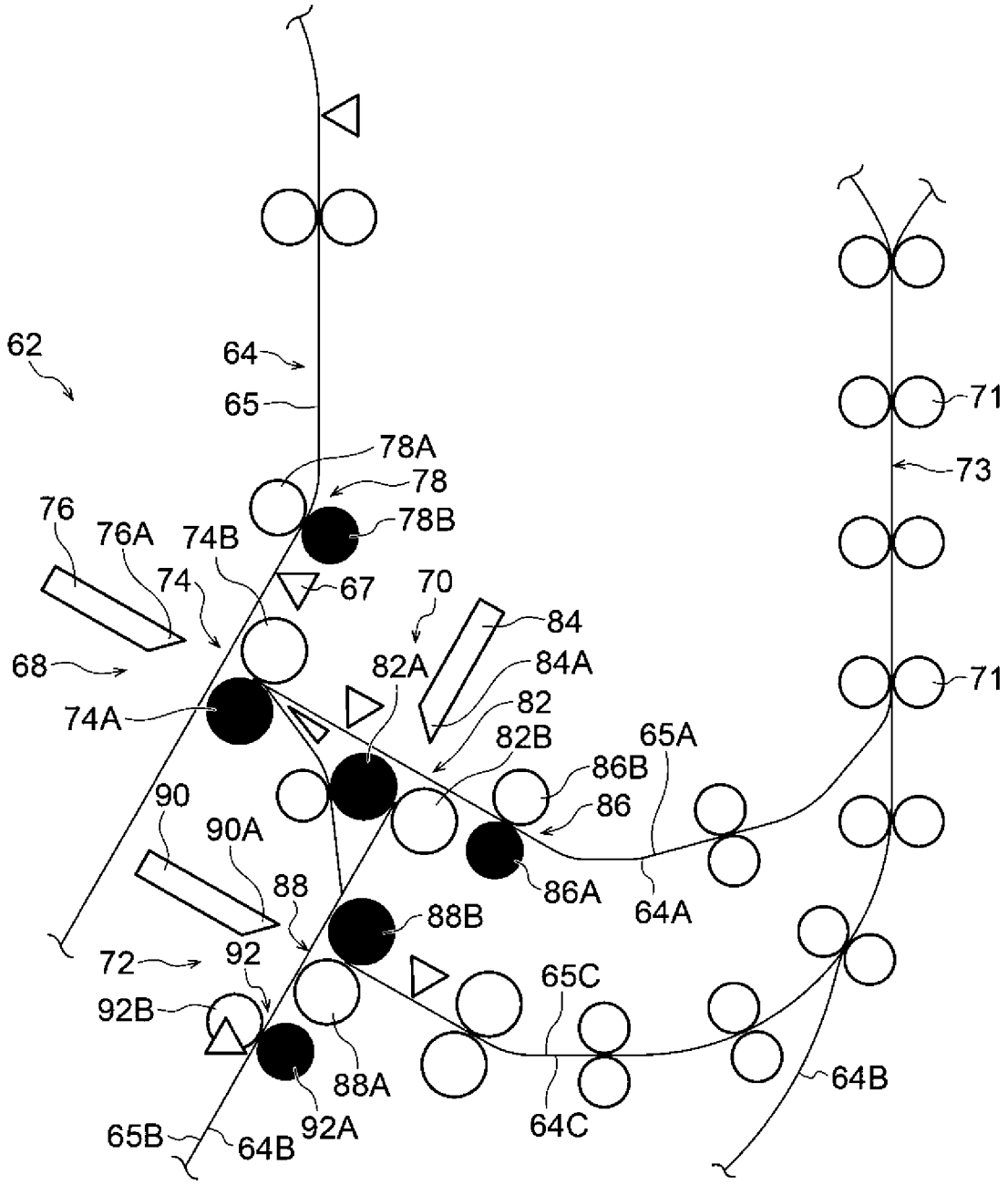
FIG. 20 is an enlarged view illustrating a folding unit of a folding apparatus according to a fourth exemplary embodiment in an enlarged manner.

On the other hand, in the present exemplary embodiment, the folding roller pair 74 of the first folding unit 68 illustrated in FIG. 20 also serves as an upstream roller pair of the second folding unit 70. The folding roller pair 82 of the second folding unit 70 also serves as an upstream roller pair of the third folding unit 72. Therefore, for example, the number of components is reduced in the present exemplary embodiment, as compared to a configuration in which dedicated upstream roller pairs are provided for the second folding unit 70 and the third folding unit 72. Of course, dedicated upstream roller pairs may be provided for the second folding unit 70 and the third folding unit 72.

In the present exemplary embodiment, the folding unit 62 for folding the sheet member P is provided at three positions (the first folding unit 68, the second folding unit 70, and the third folding unit 72). As a result, in the present exemplary embodiment, the sheet member P can be folded three times, and the folding forms are increased as compared to the case where the number of folding units is two or less.

Here, as the folding forms, for example, the case where the sheet member P is folded twice is exemplified by the Z-folding shown in FIG. 11A, the inner three-folding shown in FIG. 11B, the outer three-folding shown in FIG. 11C, and the four-folding shown in FIG. 11D. On the other hand, the case where the sheet member P is folded three times is exemplified by the bellows folding illustrated in FIG. 10A, in addition to the gates folding illustrated in FIG. 10B. In other words, in the present exemplary embodiment, it is possible to perform the gates folding, the bellows folding, and the like of the sheet member P, which cannot be performed in the case where the number of folding units is two or less.

Fifth Exemplary Embodiment

An operation of the folding apparatus 14 according to a fifth exemplary embodiment will be described.

As illustrated in FIG. 3, in the image forming apparatus 10 including the folding apparatus 14 according to the present exemplary embodiment, when a user selects not to perform folding process, the transport route 63 is selected in the folding apparatus 14, and the sheet member P formed with the image and discharged from the image forming apparatus main body 12 is discharged to the outside of the folding apparatus 14.

On the other hand, when the user selects to perform the folding process, the transport route 65 is selected in the folding apparatus 14, and the sheet member P discharged from the image forming apparatus main body 12 is subjected to the folding process.

For example, as illustrated in FIG. 10B, a case in which the sheet member P is subjected to gates folding (folded three times) will be described with reference to FIGS. 3 and 27 to 30. The sheet member P shown in FIGS. 27 to 30 is shown with a larger thickness of the sheet member P, so that the folded state of the sheet member P can be understood.

As shown in FIG. 3, the sheet member P transported by the transport path 64 constituting the transport route 65 is guided toward the guide 80 provided on the downstream side in the transport direction of the sheet member P with respect to the first folding unit 68, and the leading end of the sheet member P abuts against the abutment portion 80A of the guide 80. As a result, the leading end of the sheet member P is positioned.

Figure 27:
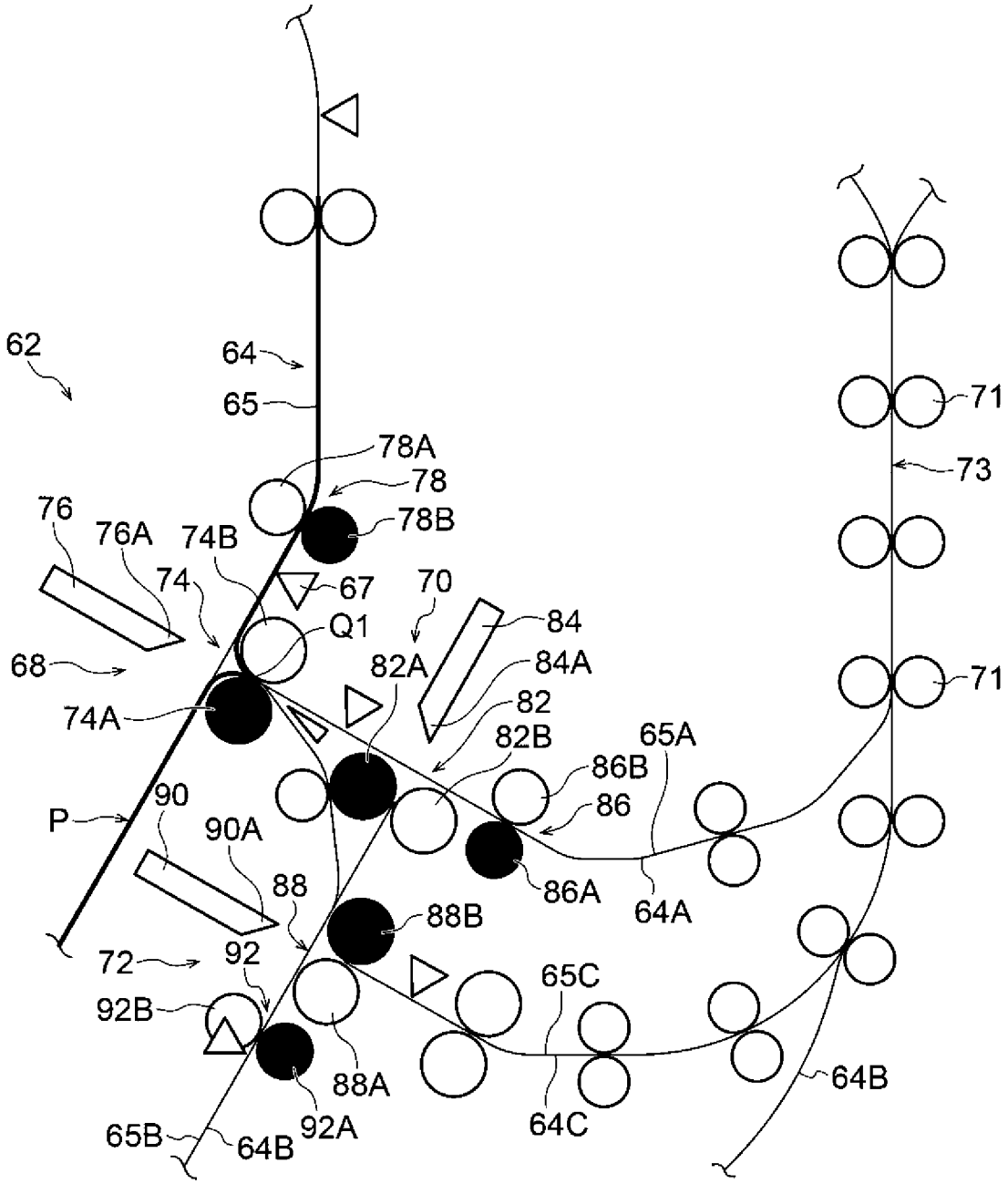
FIG. 27 is an enlarged view illustrating an operation of a first folding unit of the folding apparatus according to the fifth exemplary embodiment.

In this state, as illustrated in FIG. 27, the sheet member P is subjected to the first folding process in the first folding unit 68 (the sheet member P is folded). In the first folding unit 68, the pressing member 76 approaches the transport path 64, and the sheet member P is pressed into between the folding roller 74A and the folding roller 74B by the leading end portion 76A of the pressing member 76.

At this time, in the folding roller pair 74, the folding roller 74A is driven, and the transport force is applied to the sheet member P by driving the folding roller 74A. The sheet member P passes between the folding roller 74A and the folding roller 74B in a state of being folded from the part (Q1) of the sheet member P. As a result, the fold Q1 is created on the sheet member P, and the sheet member P is transported to the transport path 64A with the fold Q1 at the leading end.

Figure 28:
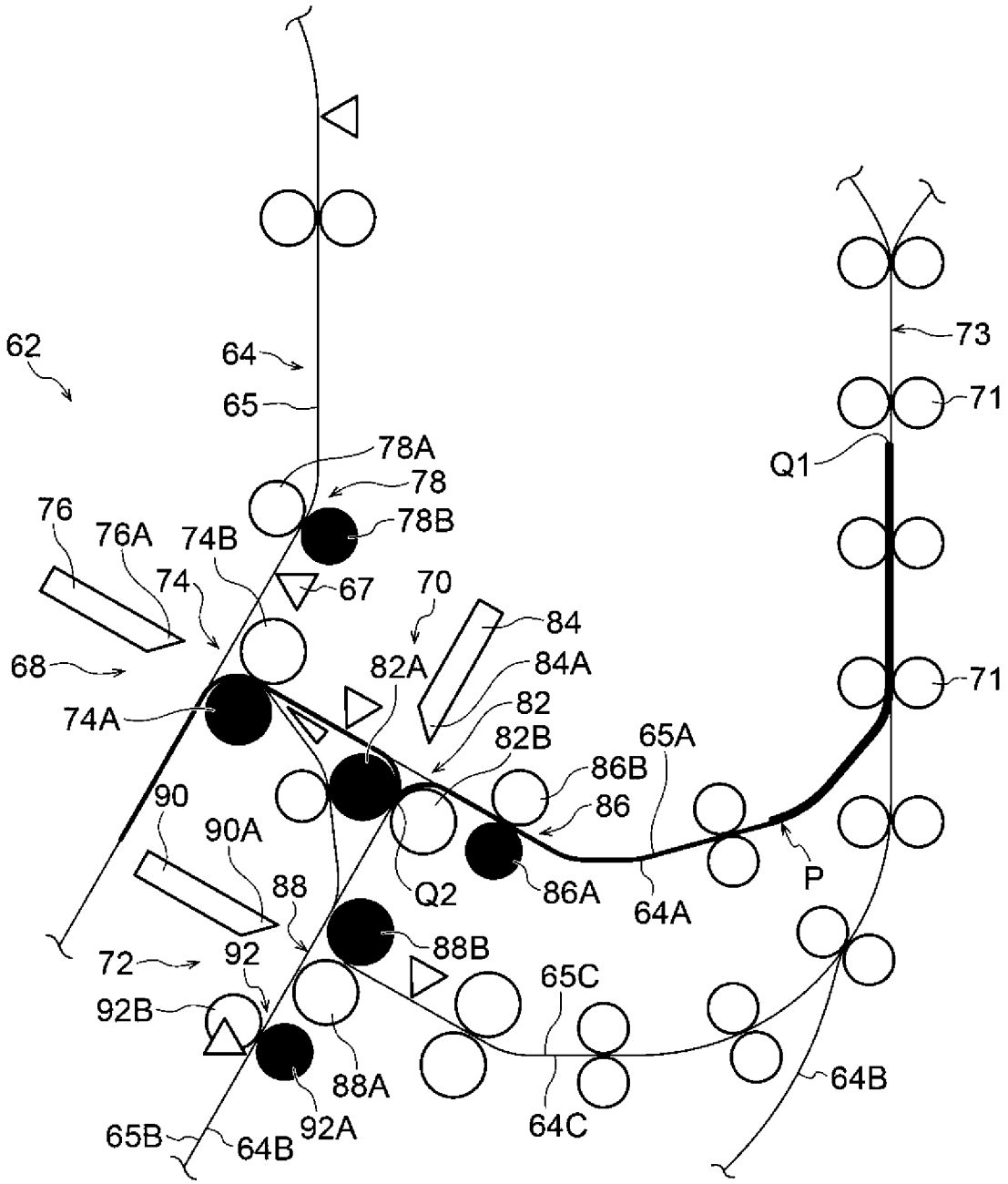
FIG. 28 is an enlarged view illustrating an operation of a second folding unit of the folding apparatus according to the fifth exemplary embodiment with a main part thereof enlarged.

Next, as illustrated in FIG. 28, the sheet member P on which the fold Q1 is created is subjected to a second folding process in the second folding unit 70. The second folding unit 70 is provided with the folding roller pair 74 as an upstream roller pair at the upstream side in the transport direction by the second folding unit 70, and is provided with the downstream roller pair 86 at the downstream side in the transport direction by the second folding unit 70.

The sheet member P is sandwiched by the folding roller pair 74 and the downstream roller pair 86, and in this state, the pressing member 84 approaches the transport path 64A, and the transport force is applied to the sheet member P by driving the folding roller pair 82 in a state in which the leading end portion 84A of the pressing member 84 is pressed into between the folding roller 82A and the folding roller 82B via the sheet member P.

The sheet member P passes between the folding roller 82A and the folding roller 82B in a state of being folded from said another part (Q2) of the sheet member P. As a result, in addition to the fold Q1, the fold Q2 is created on the sheet member P, and the sheet member P is transported to the transport path 64B with the fold Q2 at the leading end.

Figure 29:
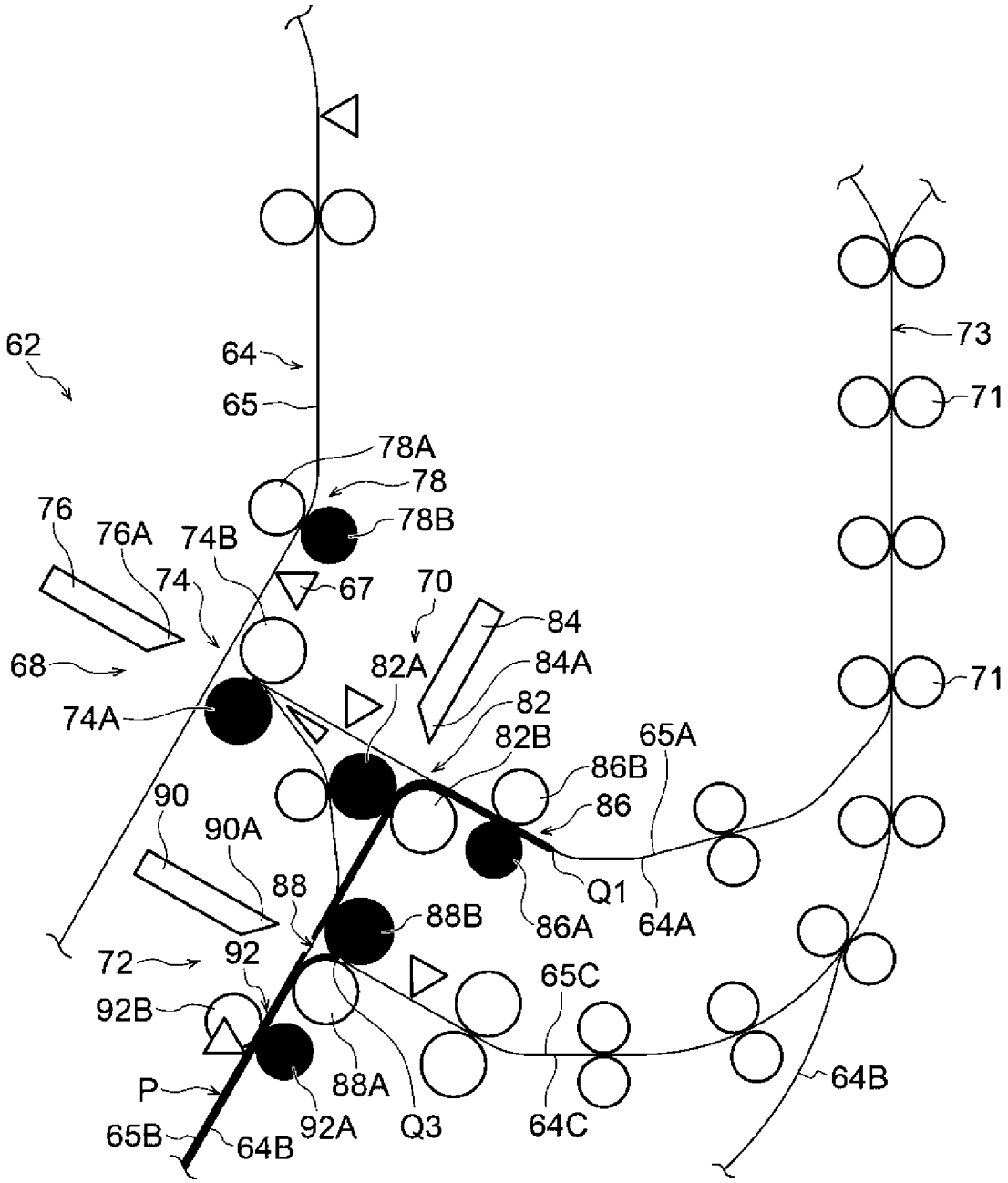
FIG. 29 is an enlarged view illustrating an operation of a third folding unit of the folding apparatus according to the fifth exemplary embodiment with a main part thereof enlarged.

Further, as illustrated in FIG. 29, the sheet member P on which the folds Q1, Q2 are created is subjected to a third folding process in the third folding unit 72. The third folding unit 72 is provided with the folding roller pair 82 as an upstream roller pair at the upstream side in the transport direction by the third folding unit 72, and is provided with the downstream roller pair 92 at the downstream side in the transport direction by the third folding unit 72.

The sheet member P is sandwiched by the folding roller pair 82 and the downstream roller pair 92, and in this state, the pressing member 90 approaches the transport path 64B, and the leading end portion 90A of the pressing member 90 is pressed into between the folding roller 88A and the folding roller 88B via the sheet member P.

On the other hand, in a state in which the sheet member P on which the folds Q1, Q2 are created is pressed into between the folding roller 88A and the folding roller 88B by the leading end portion 90A of the pressing member 90, the transport force is applied by driving the folding roller pair 88.

Figure 30:
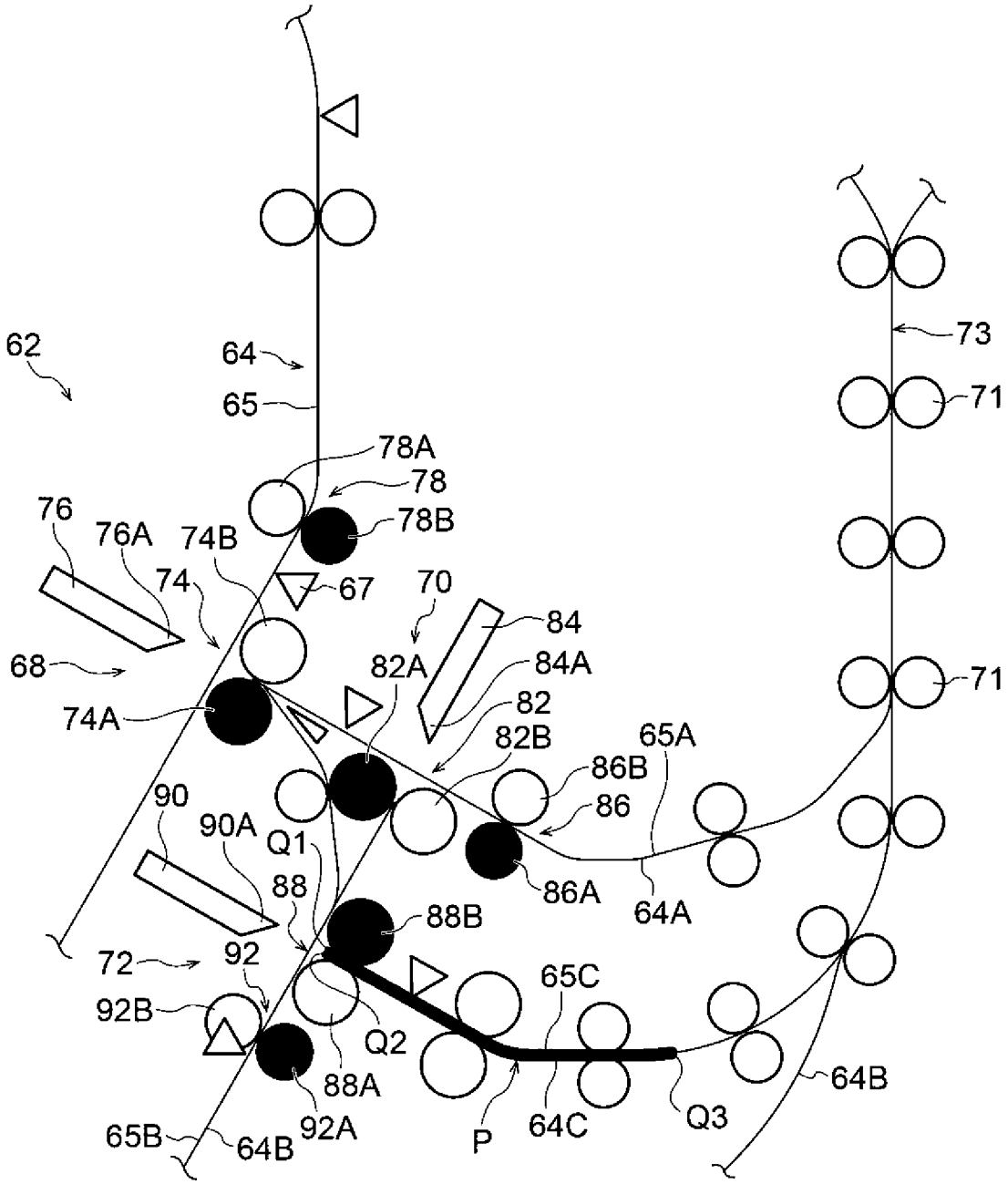
FIG. 30 is an enlarged view illustrating an operation of the third folding unit of the folding apparatus according to the fifth exemplary embodiment with a main part thereof enlarged.

The sheet member P passes between the folding roller 88A and the folding roller 88B in a state of being folded from the still another part (Q3) of the sheet member P. As a result, as illustrated in FIG. 30, in addition to the folds Q1, Q2, the fold Q3 is created on the sheet member P, and the sheet member P is transported to the transport path 64C with the fold Q3 at the leading end. In this way, the sheet member P is subjected to gates folding.

Then, the sheet member P subjected to gates folding is transported from the transport path 64C to the transport path 73, and is transported to the outside of the folding apparatus 14 (see FIG. 3).

As described above, in the present exemplary embodiment, the folding unit 62 for folding the sheet member P is provided at three positions (the first folding unit 68, the second folding unit 70, and the third folding unit 72). As a result, in the present exemplary embodiment, the sheet member P can be folded three times, and the folding forms are increased as compared to the case where the number of folding units is two or less.

Here, as the folding forms, for example, the case where the sheet member P is folded twice is exemplified by the Z-folding shown in FIG. 11A, the inner three-folding shown in FIG. 11B, the outer three-folding shown in FIG. 11C, and the four-folding shown in FIG. 11D. On the other hand, the case where the sheet member P is folded three times is exemplified by the bellows folding illustrated in FIG. 10A, in addition to the gates folding illustrated in FIG. 10B. In other words, in the present exemplary embodiment, it is possible to perform the gates folding, the bellows folding, and the like of the sheet member P, which cannot be performed in the case where the number of folding units is two or less.

Figure 26:
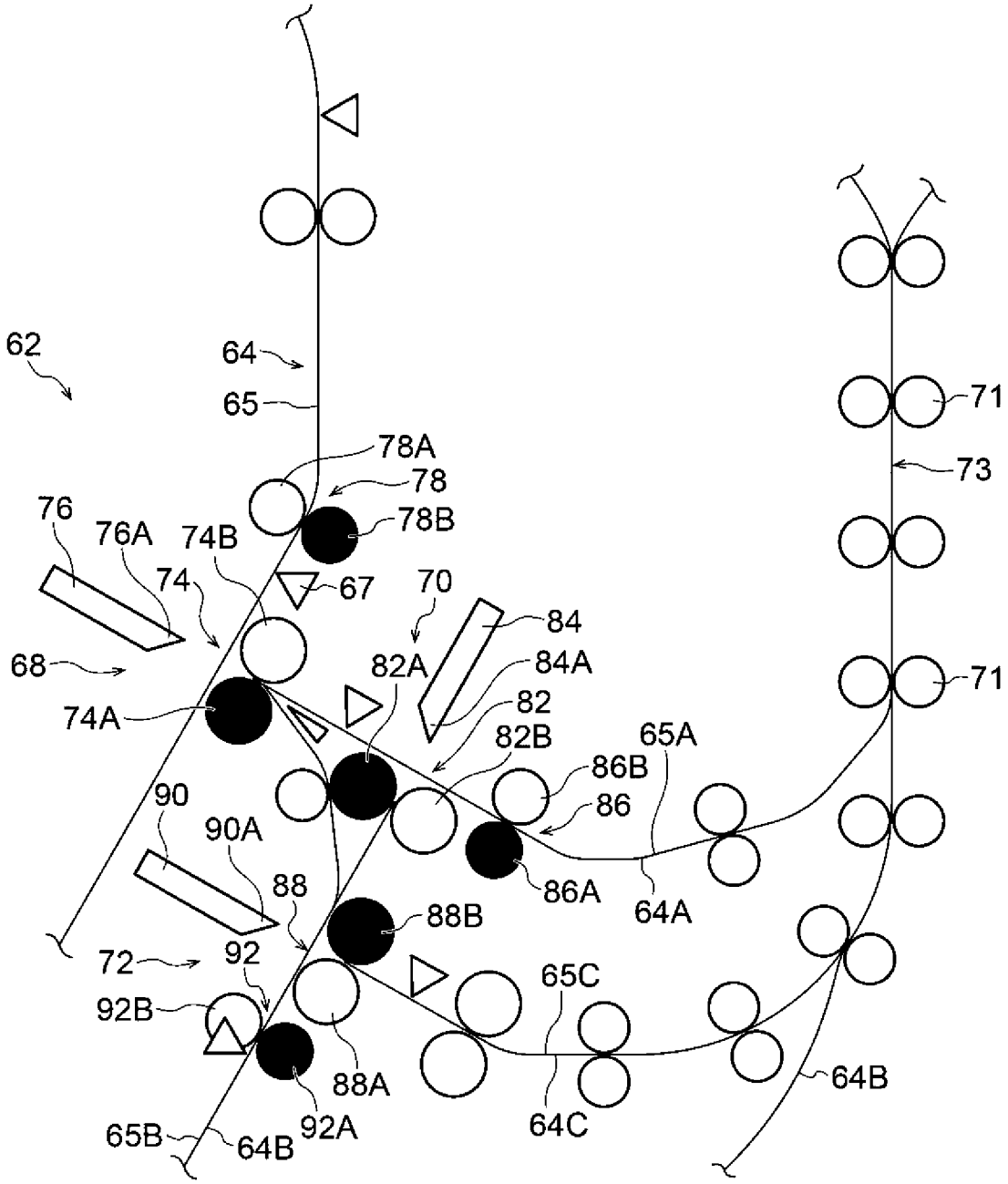
FIG. 26 is an enlarged view illustrating a folding unit of a folding apparatus according to a fifth exemplary embodiment in an enlarged manner.

In the present exemplary embodiment, as illustrated in FIG. 26, the first folding unit 68, the second folding unit 70, and the third folding unit 72 are disposed so as to form a triangular shape in a front view. Accordingly, for example, it is possible to reduce the size of the folding apparatus 14 as compared to the case where the first folding unit 68, the second folding unit 70, and the third folding unit 72 are linearly arranged.

Figure 31:
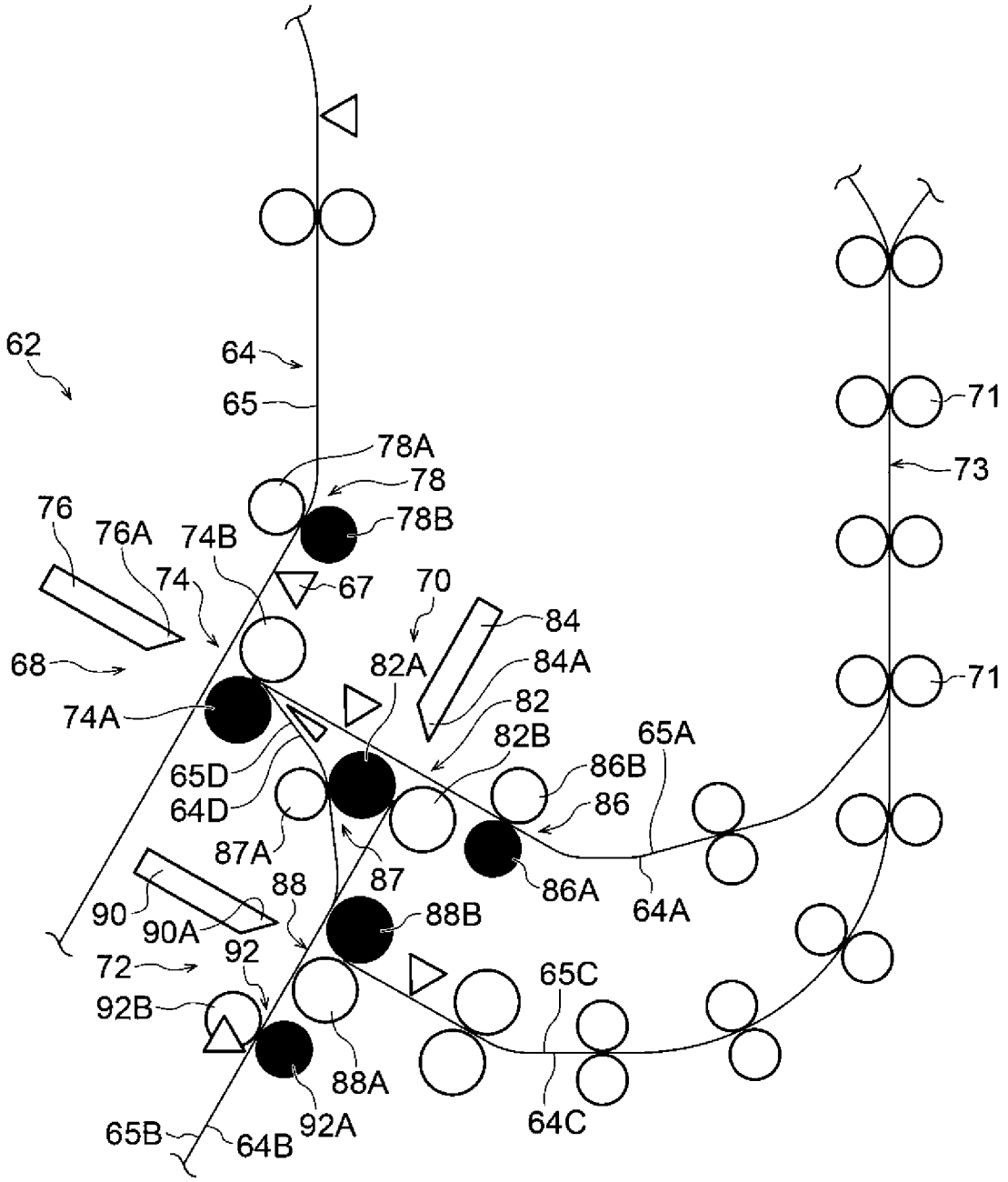
FIG. 31 is an enlarged view corresponding to FIG. 26 illustrating a modification of the folding apparatus according to the fifth exemplary embodiment.

In the present exemplary embodiment, as illustrated in FIG. 31, a transport path 64D that connects the first folding unit 68 and the third folding unit 72 is provided, and the sheet member P can be directly transported from the first folding unit 68 to the third folding unit 72.

Figure 32:
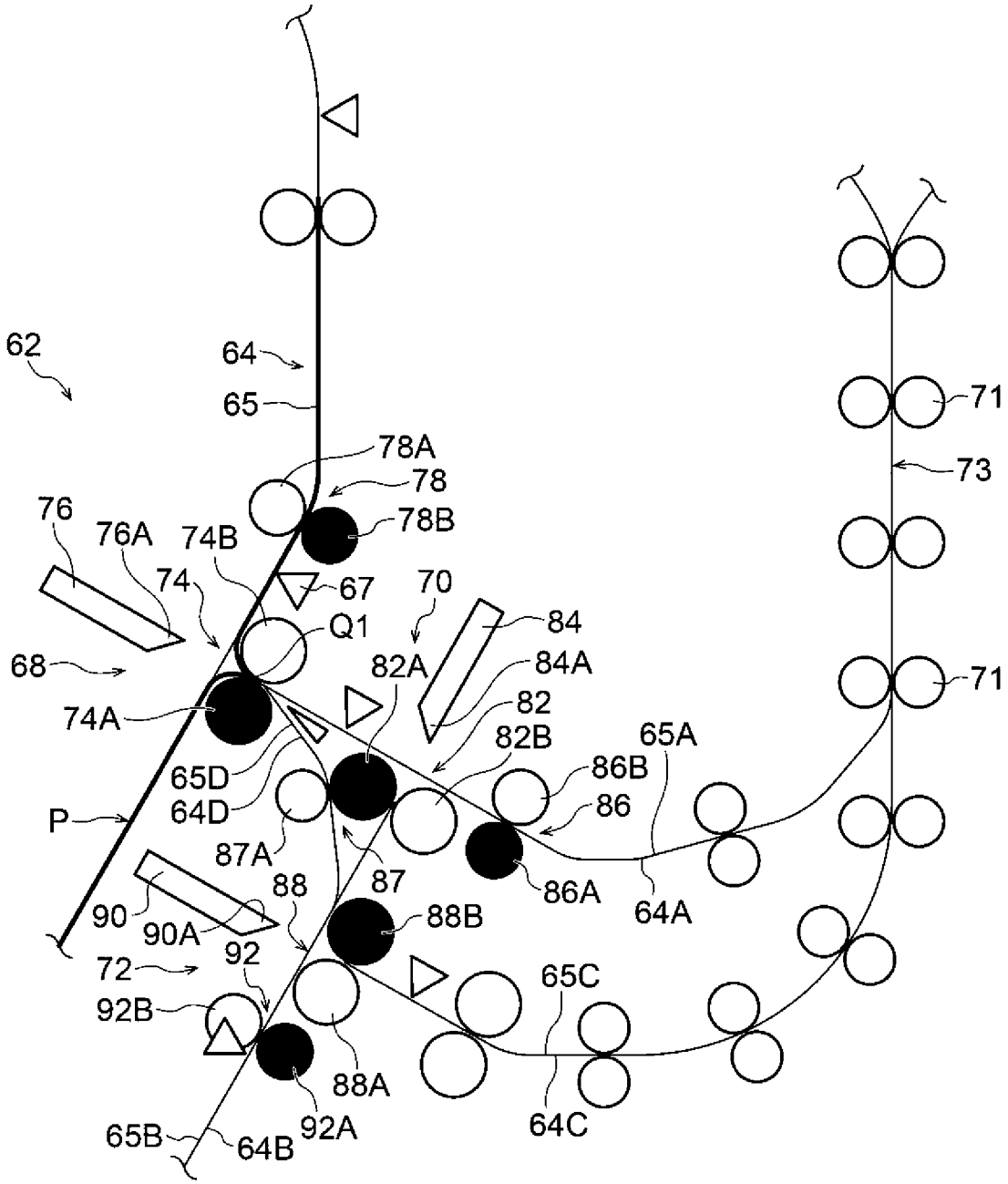
FIG. 32 is an enlarged view corresponding to FIG. 27 illustrating the modification of the folding apparatus according to the fifth exemplary embodiment.
Figure 33:
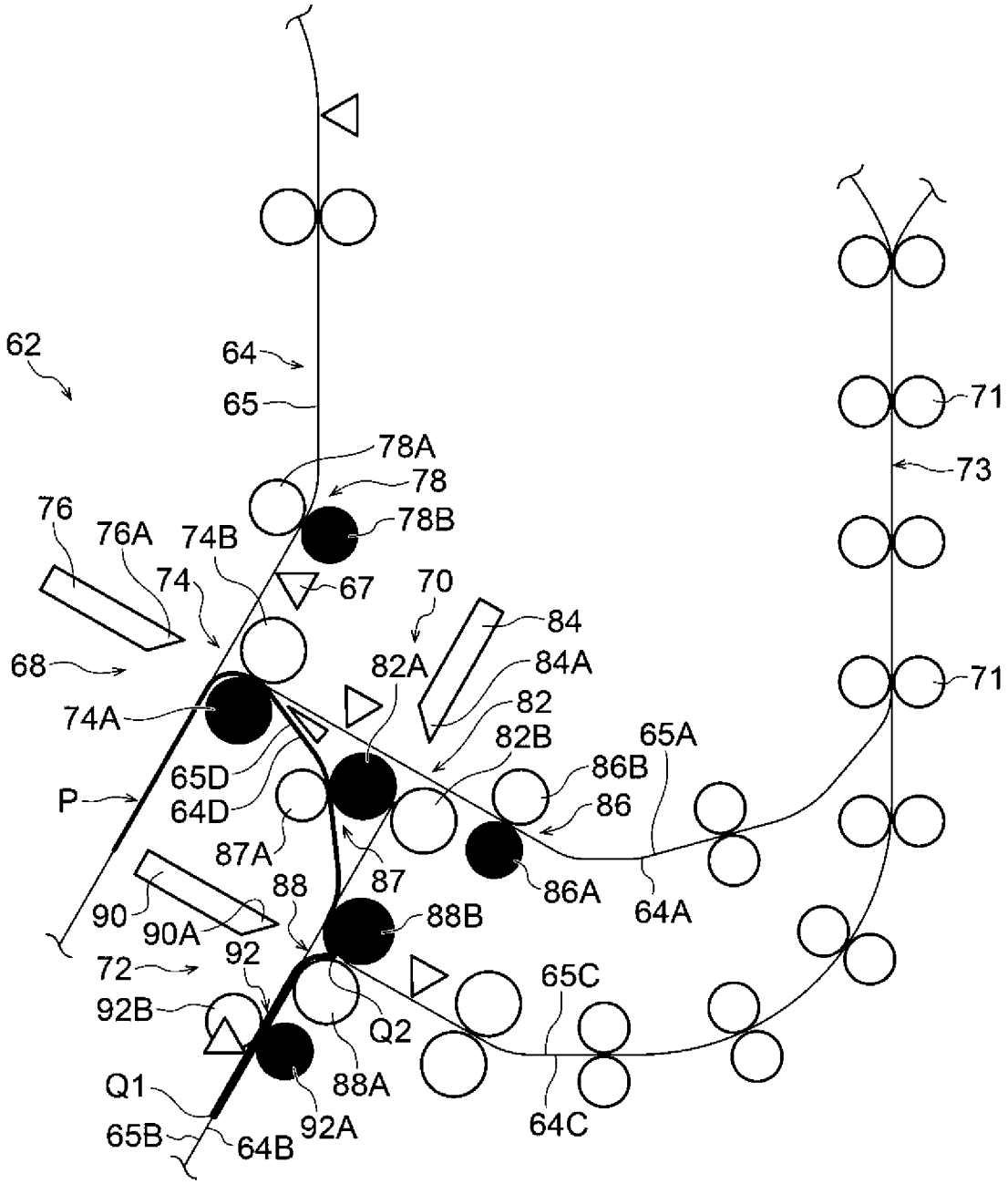
FIG. 33 is an enlarged view corresponding to FIG. 29 illustrating the modification of the folding apparatus according to the fifth exemplary embodiment.
Figure 34:
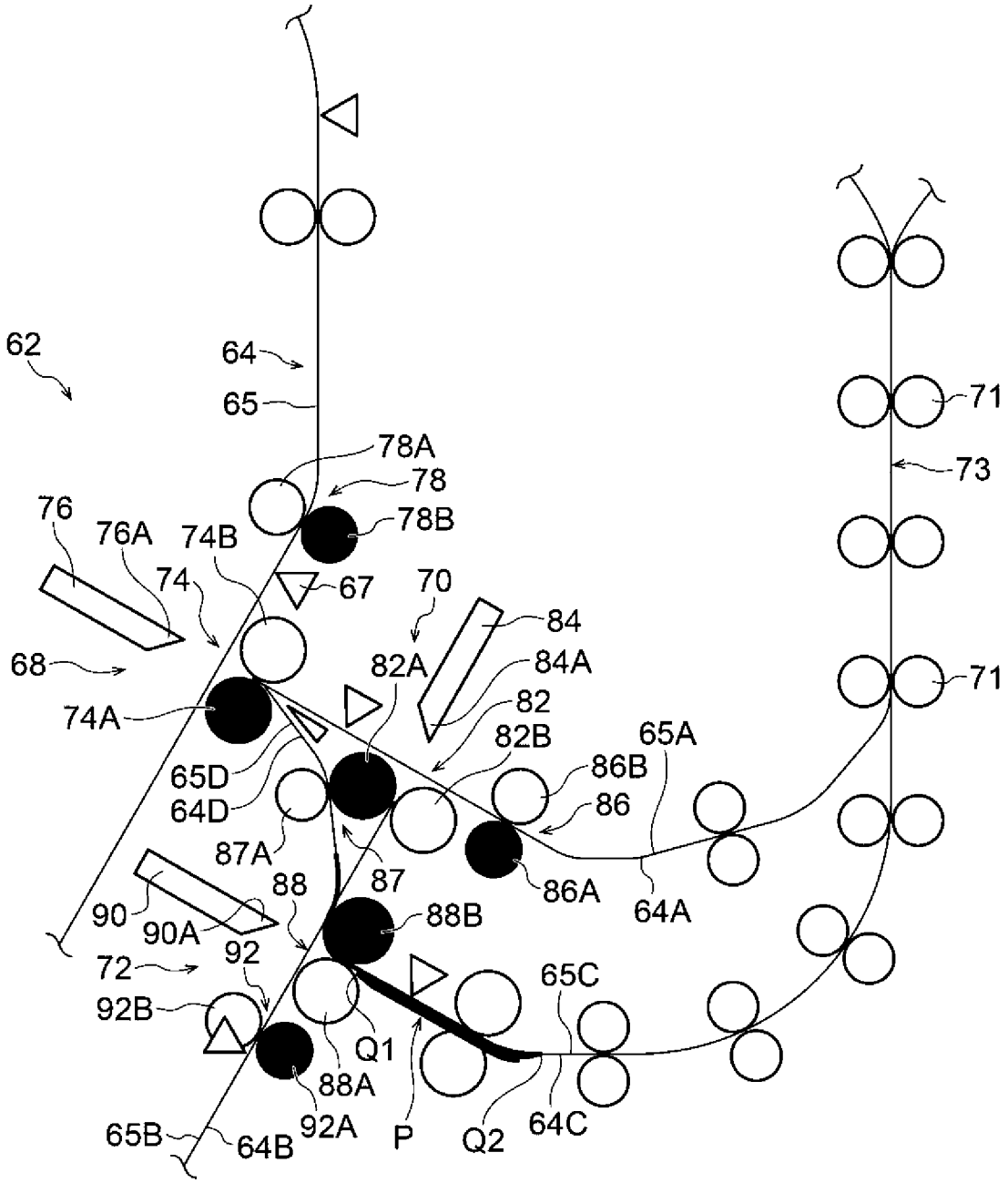
FIG. 34 is an enlarged view corresponding to FIG. 30 illustrating the modification of the folding apparatus according to the fifth exemplary embodiment.

A transport route 65D using the transport path 64D is a route in which the sheet member P is transported in a case where the sheet member P is to be folded twice. As illustrated in FIGS. 32 to 34, the sheet member P is transported to the outside of the folding apparatus 14 by the transport path 64D, the transport path 64C, and the transport path 73 branched from the transport route 65.

For example, in a case without the transport path 64D, when the sheet member P is to be folded twice, as illustrated in FIG. 28, the sheet member P is subjected to the first folding process in the first folding unit 68, then subjected to the second folding process in the second folding unit 70, and transported to the outside of the folding apparatus 14 by the transport path 64B and the transport path 73.

On the other hand, the present exemplary embodiment includes the transport path 64D. Therefore, when the sheet member P is to be folded twice, the sheet member P is subjected to the first folding process in the first folding unit 68 as illustrated in FIG. 32, but is subjected to the second folding process in the third folding unit 72 as illustrated in FIG. 33.

Therefore, in the present exemplary embodiment, the sheet member P is transported to the outside of the folding apparatus 14 by the transport path 64D, the transport path 64C, and the transport path 73. That is, in the present exemplary embodiment, the transport path 64C, which is used when the sheet member P is to be folded three times, is used when the sheet member P is to be folded twice. In this way, by sharing the transport path 64C between the case where the sheet member P is to be folded twice and the case where the sheet member P is to be folded three times, it is not required to provide the dedicated transport path 64B which is used when the sheet member P is to be folded twice.

Therefore, in the folding apparatus 14 according to the present exemplary embodiment, it is possible to eliminate the transport path 64B. This enables reduction in the size of the folding apparatus 14 as compared to a case where transport paths are provided corresponding to the number of times of folding of the sheet member P.

Further, the present exemplary embodiment is provided with the transport path 64D which directly guides the sheet member P from the first folding unit 68 to the third folding unit 72, which improves productivity as compared to a case in which the sheet member P is transported from the first folding unit 68 to the third folding unit 72 via the second folding unit 70 when the sheet member P is to be folded twice.

The above exemplary embodiment describes a specification in which, when the sheet member P is to be folded twice, the first folding process is performed in the first folding unit 68 and the second folding process is performed in the third folding unit 72, but of course, the second folding process may be performed in the second folding unit 70 after the first folding process is performed in the first folding unit 68.

In this manner, the folding process of the sheet member P is performed in an order of the first folding unit 68 and the second folding unit 70 in accordance with the number of times of folding of the sheet member P. Thus, the number of the folding path may be only one regardless of the number of times of folding, which enables simplification of the mechanism, as compared with a case where the sheet member P is transported from the first folding unit 68 to the third folding unit 72 when the sheet member P is to be folded twice.

Further, since the folding process of the sheet member P is performed in an order of the first folding unit 68 and the second folding unit 70 in accordance with the number of times of folding of the sheet member P, control is easier as compared to a case where the transport path is shared.

In the present exemplary embodiment, the folding roller pair 74 of the first folding unit 68 illustrated in FIG. 26 also serves as an upstream roller pair of the second folding unit 70. The folding roller pair 82 of the second folding unit 70 also serves as an upstream roller pair of the third folding unit 72. Therefore, for example, the number of components is reduced in the present exemplary embodiment, as compared to a configuration in which dedicated upstream roller pairs are provided for the second folding unit 70 and the third folding unit 72. Of course, dedicated upstream roller pairs may be provided for the second folding unit 70 and the third folding unit 72.

Although an exemplary embodiment of the present disclosure has been described above as an example, the present disclosure is not limited to such an exemplary embodiment, and may have various modifications, or only two folding units may be provided as the folding apparatus, as long within a range not departing from the gist of the present disclosure.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

REFERENCE SIGNS LIST

10 image forming apparatus
12 image forming apparatus main body (forming unit)
14 folding apparatus
62 folding unit
64A1 branch path (transport route)
64B transport path
64C transport path
64D transport path
65A transport path
65C transport path
68 first folding unit (upstream folding unit, initial folding unit)
70 second folding unit (folding unit)
72 third folding unit (folding unit)
74 folding roller pair (upstream roller pair)
76 pressing member
78 upstream roller pair
80 transport unit
80A abutment portion
82 folding roller (upstream roller pair)
84 pressing member
86 downstream roller pair
86A downstream roller (driving roller, first roller pair)
86B downstream roller (first roller pair)
86C downstream roller (second roller pair)
86D downstream roller (driving roller, second roller pair)
88 folding roller pair (downstream roller pair)
90 pressing member
92 downstream roller pair
100 folding apparatus
102 switching unit
P sheet member (recording medium)
Q1 fold
Q2 fold
Q3 fold (folding target portion)

What is claimed is:

1. A folding apparatus comprising:

a folding unit configured to fold a recording medium at an intermediate portion in a transport direction of the recording medium;

an upstream roller pair disposed on an upstream side in the transport direction of the recording medium with respect to the folding unit, and configured to transport the recording medium in a folded state toward the folding unit with a fold as a leading end; and at least one downstream roller pair disposed on a downstream side in the transport direction of the recording medium with respect to the folding unit, and configured to sandwich and transport the recording medium sandwiched between the upstream roller pair, the downstream roller pair being configured to apply a transport force to a portion of the recording medium that is connected to a portion of the recording medium that is sandwiched between the upstream roller pair, wherein the downstream roller pair is configured to switch between a state in which a roller on one side with respect to a transport route is driven and a state in which a roller on other side with respect to the transport route is driven, in accordance with a folding form of the recording medium transported by the upstream roller pair.

2. The folding apparatus according to claim 1, wherein the at least one downstream roller pair includes a first roller pair in which a driving roller is disposed on one side with respect to a transport route, and a second roller pair in which a driving roller is disposed on other side with respect to the transport route, and the folding apparatus further comprises a switching unit configured to switch a transport destination of the recording medium to one of the first roller pair and the second roller pair according to a folding form of the recording medium transported by the upstream roller pair.

3. The folding apparatus according to claim 1, further comprising:

an upstream folding unit configured to form a fold on the recording medium transported by the upstream roller pair; and an abutment portion provided on the downstream side in the transport direction of the recording medium to the upstream folding unit and configured to abut against the recording medium before being folded by the upstream folding unit.

4. The folding apparatus according to claim 2, further comprising:

an upstream folding unit configured to form a fold on the recording medium transported by the upstream roller pair; and an abutment portion provided on the downstream side in the transport direction of the recording medium to the upstream folding unit and configured to abut against the recording medium before being folded by the upstream folding unit.

5. An image forming apparatus comprising:

a forming unit configured to form an image on a recording medium; and the folding apparatus according to claim 1.

* * * * *